US010391036B2

(12) United States Patent
Koike et al.

(10) Patent No.: US 10,391,036 B2
(45) Date of Patent: Aug. 27, 2019

(54) MEDICINE CASSETTE, MEDICINE DISPENSING APPARATUS AND MEDICINE PACKAGING APPARATUS

(71) Applicant: YUYAMA MFG. CO., LTD., Toyonaka-shi, Osaka (JP)

(72) Inventors: Naoki Koike, Toyonaka (JP); Takanori Yorozu, Toyonaka (JP); Shoichiro Okada, Toyonaka (JP); Kenichi Takada, Toyonaka (JP)

(73) Assignee: YUYAMA MFG. CO., LTD., Toyonaka-shi, Osaka (JP)

( * ) Notice: Subject to any disclaimer, the term of this patent is extended or adjusted under 35 U.S.C. 154(b) by 0 days.

(21) Appl. No.: 15/779,837

(22) PCT Filed: Nov. 28, 2016

(86) PCT No.: PCT/JP2016/085251
§ 371 (c)(1),
(2) Date: May 29, 2018

(87) PCT Pub. No.: WO2017/094687
PCT Pub. Date: Jun. 8, 2017

(65) Prior Publication Data

US 2018/0369071 A1 Dec. 27, 2018

(30) Foreign Application Priority Data

Nov. 30, 2015 (JP) ..... 2015-234280

(51) Int. Cl.
*A61J 7/00* (2006.01)
*G07F 11/54* (2006.01)
(Continued)

(52) U.S. Cl.
CPC ..... *A61J 7/0076* (2013.01); *A61J 3/00* (2013.01); *G07F 11/54* (2013.01);
(Continued)

(58) Field of Classification Search
CPC ..... G07F 17/0092
(Continued)

(56) References Cited

U.S. PATENT DOCUMENTS 5,086,945 A 2/1992 Corella
5,535,917 A * 7/1996 Ribouleau ..... A01C 7/046 111/77
(Continued)

FOREIGN PATENT DOCUMENTS

EP 2813436 A1 12/2014
JP 2006-232351 A 9/2006
(Continued)

OTHER PUBLICATIONS

EPO, European Search Report dated May 10, 2019 for EP Patent Application No. 16870624.0, 9 pages.
(Continued)

*Primary Examiner* — Jacob S. Scott
*Assistant Examiner* — Ayodeji T Ojofeitimi
(74) *Attorney, Agent, or Firm* — Masuvalley & Partners

(57) ABSTRACT

A medicine cassette 100 includes a side-wall constituent body 110, a first rotating body 120, a second rotating body 130 and a medicine discharging part 144*c*. The medicine cassette 100 can scrape up medicines prepared in a medicine containing part 182 along with a rotation of the first rotating body 120 to transfer and place the medicines onto the second rotating body 130 and transfer the medicines toward a downstream side of a rotational direction of the second rotating body 130 to discharge the medicines from the medicine discharging part 144*c*. An expanding portion 110*a* expanding toward an outer side of a radial direction of the second rotating body 130 is provided in the side-wall constituent body 110 on a lower side of the second rotating body 130.

16 Claims, 25 Drawing Sheets

(51) Int. Cl.
*G07F 17/00* (2006.01)
*A61J 3/00* (2006.01)

(52) U.S. Cl.
CPC ..... *G07F 17/0092* (2013.01); *A61J 2200/72* (2013.01); *A61J 2205/30* (2013.01)

(58) Field of Classification Search
USPC ..... 221/258, 211, 237, 224, 262
See application file for complete search history.

(56) References Cited

U.S. PATENT DOCUMENTS 6,109,193 A * 8/2000 Crabb ..... A01C 7/046 111/185
8,813,997 B2 * 8/2014 Karwacki, Jr. ..... G07F 9/026 221/2
8,827,112 B2 * 9/2014 Yuyama ..... A61J 7/02 221/237
8,950,386 B2 * 2/2015 Hedberg ..... F41B 11/52 124/48
9,038,816 B2 * 5/2015 Koike ..... A61J 7/02 198/803.16
9,877,896 B2 * 1/2018 Mitani ..... A61J 7/0076
2002/0062771 A1 * 5/2002 Unruh ..... A01C 7/046 111/185
2002/0096535 A1 * 7/2002 Zhang ..... B65B 35/08 221/258
2013/0284755 A1 * 10/2013 Yuyama ..... A61J 7/02 221/13
2014/0246451 A1 * 9/2014 Yuyama ..... B65B 35/06 221/7
2015/0190312 A1 7/2015 Yuyama et al.
2016/0151245 A1 * 6/2016 Yuyama ..... G07F 11/24 221/277
2016/0167866 A1 * 6/2016 Omura ..... B65B 35/06 221/173
2016/0229564 A1 * 8/2016 Koike ..... A61J 7/0076
2017/0224587 A1 * 8/2017 Koike ..... A61J 7/0084
2017/0359948 A1 * 12/2017 do Amaral Assy ..... A01C 1/00

FOREIGN PATENT DOCUMENTS

WO 2012/099189 A1 7/2012
WO 2013141130 A1 9/2013
WO 2015041220 A1 3/2015

OTHER PUBLICATIONS

ISA/JPO, International Search Report issued in PCT/JP2016/085251, dated Feb. 21, 2017, total 2 pages with English translation.

* cited by examiner

MEDICINE CASSETTE, MEDICINE DISPENSING APPARATUS AND MEDICINE PACKAGING APPARATUS

RELATED APPLICATIONS

This application is a national phase application under 35 U.S.C. § 371 of International Patent Application No. PCT/JP2016/085251, filed on Nov. 28, 2016, which claims priority under 35 U.S.C. § 119 to Japanese Patent Application No. 2015-234280, filed on Nov. 30, 2015, which are hereby expressly incorporated by reference in their entirety for all purposes.

TECHNICAL FIELD

The present invention relates to a medicine cassette, a medicine dispensing apparatus and a medicine packaging apparatus.

BACKGROUND ART

Heretofore, there has been provided a medicine packaging apparatus as disclosed in the following patent document 1: JP 2006-232351A. This medicine packaging apparatus includes a medicine feeder or a manually distributing part through which medicines can be manually distributed. A plurality of concave portions into which the medicines are distributed are provided in the manually distributing part. By distributing the medicines for one package in each concave portion in advance, it becomes possible to dispense and package the medicines for one package. Further, medicine cassettes which can contain a number of medicines are provided in the medicine feeder and this makes it possible to discharge the medicines one by one according to prescription.

SUMMARY OF THE INVENTION

Here, in a medical field site in recent years, so-called generic medicines are used and thus the number of kinds of medicines used in the medical field site is becoming enormous. There are limits in a space for setting the medicine packaging apparatus and kinds of medicines which can be prepared in the medicine feeder. Thus, in a conventional medicine packaging apparatus or a medicine dispensing device and a medicine cassette used in the conventional medicine packaging apparatus, there is concern that it becomes impossible to respond to the increase of the number of handling medicines in future. Further, although it can be contemplated that a method of utilizing the above-mentioned manually distributing part in a case of prescribing medicines which cannot be prepared in the medicine feeder, this possibly leads to a decrease in work efficiency and induces human errors.

In view of the above problem, the present invention is intended to provide a medicine cassette, a medicine dispensing apparatus and a medicine packaging apparatus which can suppress occurrence of human errors caused by manual operations using a manually distributing part or the like to a minimum and smoothly dispense medicines with a minimum space.

A medicine cassette of the present invention provided for solving the above problem is characterized in that: the medicine cassette comprises a side-wall constituent body constituting a side-wall of a medicine containing part in which medicines should be contained, a first rotating body which is arranged so as to be inclined from a bottom side toward an upper end side of the side-wall constituent body and can rotate around a first rotational axis inclined with respect to an axial line of the side-wall constituent body, a second rotating body which is arranged on an upper end side outer periphery of the side-wall constituent body and which can rotate around a second rotational axis and a medicine discharging part for discharging the medicines, wherein the medicine cassette can transfer and place the medicines prepared in the medicine containing part onto the second rotating body due to a rotation of the first rotating body and transfer the medicines toward a downstream side of a rotational direction of the second rotating body to discharge the medicines from the medicine discharging part and wherein the side-wall constituent body has an expanding portion expanding toward an outer side of a radial direction of the second rotating body on a lower side of the second rotating body.

In the medicine cassette of the present invention, the expanding portion is provided on the side-wall constituent body. The expanding portion expands toward the outer side of the radial direction on the lower side of the second rotating body and thus it is possible to make the medicine containing part large by an amount corresponding to an expanding amount of the expanding portion 110*a*, thereby efficiently utilizing an area on the lower side of the second rotating body. Thus, according to the present invention, it is possible to ensure a containing amount of the medicines and provide the medicine cassette which is compact and can suppress a setting space to a minimum.

The medicine cassette of the present invention can appropriately and smoothly discharge the medicines by performing rotation control for the first rotating body and the second rotating body if the medicines are prepared in the medicine containing part in advance. With this configuration, it is possible to suppress occurrence of human errors caused by manuals operation to a minimum.

Here, in the medicine cassette of the present invention, the medicine containing part is formed by partitioning a space with the side-wall constituent body and the first rotating body. An area on the lower side of the first rotating body does not contribute to the containing of the medicines. Thus, in the case of providing the above-mentioned expanding portion, it is possible to improve space efficiency in the medicine cassette and a volume of the medicine containing part with making the medicine cassette compact by providing the expanding portion with considering a positional relationship with respect to the first rotating body.

Based on such knowledge, in the above-mentioned medicine cassette, it is preferable that the expanding portion is provided in an area on the opposite side of a radial direction of the first rotating body with respect to a position where an outer peripheral edge of the first rotating body and an inner peripheral edge of the second rotating body are adjacent to each other.

In the medicine cassette of the present invention, the first rotating body is arranged so as to be inclined from the bottom side toward the upper end side. Thus, at a position where the outer peripheral edge of the first rotating body and the inner peripheral edge of the second rotating body are adjacent to each other (hereinafter, this position is sometimes referred to as "rotating bodies adjacent portion"), the first rotating body exists on the upper end side of the side-wall constituent body. Thus, even if the expanding portion is provided on this lower side, this does not contribute to the improvement of the volume of the medicine containing part. Further, if the expanding portion is provided on the side of the rotating bodies adjacent portion, this possibly causes deterioration of the space efficiency in the medicine cassette. In contrast, at a position on the opposite side of the radial direction of the first rotating body with respect to the rotating bodies adjacent portion, the first rotating body exists on the bottom side of the side-wall constituent body. Thus, even if the expanding portion is provided in an area on this side, it is possible to remarkably contribute to the improvement of the volume of the medicine containing part. In the present invention, since the expanding portion is provided at the position on the opposite side of the radial direction of the first rotating body with respect to the rotating bodies adjacent portion, it is possible to further contribute to the improvements of the space efficiency in the medicine cassette and the volume of the medicine containing portion with making the medicine cassette compact.

In the above-mentioned medicine cassette, when the area where the outer peripheral edge of the first rotating body and the inner peripheral edge of the second rotating body are adjacent to each other is defined as a riding-over side area and the area on the opposite side of the radial direction of the first rotating body with respect to the ride-over side area is defined as a scraping-up side area, it is preferable that the expanding portion is provided at least in the scraping-up side area.

As described above, in the medicine cassette of the present invention, the first rotating body is arranged so as to be inclined from the bottom side toward the upper end side. Thus, the first rotating body exists on the upper end side of the side-wall constituent body in the riding-over side area and exists on the bottom side of the side-wall constituent body in the scraping-up side area. Therefore, even if the expanding portion is provided in the riding-over side area, the expanding portion exists on the lower side of the first rotating body and does not substantially contribute to the improvement of the volume of the medicine containing part. Further, in the case where the expanding portion is provided in the riding-over side area, this possibly causes the deterioration of the space efficiency in the medicine cassette. In contrast, the first rotating body is located on the bottom side of the side-wall constituent body in the scraping-up side area. Thus, if the expanding portion is provided in the scraping-up area, it becomes possible to remarkably contribute to the improvement of the volume of the medicine containing part. In the present invention, since the expanding portion is provided in the scraping-up side area, it is possible to further contribute to the improvements of the space efficiency in the medicine cassette and the volume of the medicine containing part with making the medicine cassette compact.

A medicine cassette of the present invention provided for solving the above-mentioned problem comprises a side-wall constituent body constituting a side-wall of a medicine containing part in which medicines should be contained, a first rotating body which is arranged so as to be inclined from a bottom side toward an upper end side of the side-wall constituent body and can rotate around a first rotational axis inclined with respect to an axial line of the side-wall constituent body, a second rotating body which is arranged on an upper-side outer periphery of the side-wall constituent body and which can rotate around a second rotational axis and a medicine discharging part for discharging the medicines, wherein the medicine cassette can transfer and place the medicines prepared in the medicine containing part onto the second rotating body due to a rotation of the first rotating body and transfer the medicines toward a downstream side of a rotational direction of the second rotating body to discharge the medicines from the medicine discharging part and wherein a transferred medicine detecting device which can detect the medicines in a transfer path to the medicine discharging part after the medicines are transferred and placed from the first rotating body onto the second rotating body is provided in the medicine cassette.

In the medicine cassette of the present invention, the transferred medicine detecting device is provided and thus it becomes possible to detect the medicines in the transfer path to the medicine discharging part after the medicines are transferred and placed from the first rotating body onto the second rotating body. Therefore, according to the present invention, it is possible to identify a transfer status of the medicines based on a detection signal due to the transferred medicine detecting device and utilize it for operation control for the medicine cassette and the like.

Further, since the medicine cassette of the present invention includes the transferred medicine detecting device, it is possible to utilize a detection result obtained by the transferred medicine detecting device for discharging control for the medicines and use it for optimizing a dispensing operation for the medicines. Further, by using the medicine cassette of the present invention, it is possible to suppress manual operations to a minimum and expect a certain degree of effectiveness for avoiding human errors.

The above-mentioned medicine cassette of the present invention may take a configuration in which the position where an outer peripheral edge of the first rotating body and an inner peripheral edge of the second rotating body are adjacent to each other is defined as a reference position and the transferred medicine detecting device is provided so as to be capable of detecting the medicines in the transfer path from the reference position to the discharging part.

In the medicine cassette of the present invention, it is expected that the medicines are transferred and placed from the first rotating body onto the second rotating body at the position (the reference position) where the outer peripheral edge of the first rotating body and the inner peripheral edge of the second rotating body are adjacent to each other or in the vicinity of this position. Thus, by arranging the transferred medicine detecting device in the transfer path from the reference position to the medicine discharging part like the present invention, it is possible to accurately identify whether or not the medicines prepared in the medicine containing part are transferred and placed onto the second rotating body.

A medicine cassette of the present invention provided for solving the above-mentioned problem is characterized in that: the medicine cassette comprises a side-wall constituent body constituting a side-wall of a medicine containing part in which medicines should be contained, a first rotating body which is arranged so as to be inclined from a bottom side toward an upper end side of the side-wall constituent body and can rotate around a first rotational axis inclined with respect to an axial line of the side-wall constituent body, a second rotating body which is arranged on an upper-side outer periphery of the side-wall constituent body and which can rotate around a second rotational axis and a medicine discharging part for discharging the medicines, wherein the medicine cassette can transfer and place the medicines prepared in the medicine containing part onto the second rotating body due to a rotation of the first rotating body and transfer the medicines toward a downstream side of a rotational direction of the second rotating body to discharge the medicines from the medicine discharging part and wherein the first rotating body is formed into a concave shape on the side of the medicine containing part.

In the medicine cassette of the present invention, the first rotating body is formed into a concave shape on the side of the medicine containing part. With this configuration, compared with the case where the first rotating body is formed into a shape such as a plate-like shape, it is possible to improve a volume of the medicine containing part and make the medicine cassette compact.

By using the medicine cassette of the present invention, it is possible to appropriately and smoothly discharge the medicines by controlling rotations of the first rotating body and the second rotating body if the medicines are prepared in the medicine containing part. With this configuration, it is possible to suppress occurrence of human errors caused by manual operations to a minimum.

Here, in the medicine cassette of the present invention, it is preferable that the transferring and placing of the medicines from the first rotating body onto the second rotating body is smoothly performed in order to allow the medicines prepared in the medicine containing part to quickly reach the medicine discharging part.

A medicine cassette of the present invention provided based on such knowledge is characterized in that: the medicine cassette comprises a side-wall constituent body constituting a side-wall of a medicine containing part in which medicines should be contained, a first rotating body which is arranged so as to be inclined from a bottom side toward an upper end side of the side-wall constituent body and can rotate around a first rotational axis inclined with respect to an axial line of the side-wall constituent body, a second rotating body which is arranged on an upper-side outer periphery of the side-wall constituent body and which can rotate around a second rotational axis and a medicine discharging part for discharging the medicines, wherein the medicine cassette can transfer and place the medicines prepared in the medicine containing part onto the second rotating body due to a rotation of the first rotating body and transfer the medicines toward a downstream side of a rotational direction of the second rotating body to discharge the medicines from the medicine discharging part and wherein a gradient of a direction directed from an inner side toward an outer side of a radial direction of the first rotating body at an outer peripheral portion of the first rotating body is smaller than a gradient of the direction directed from the inner side toward the outer side of the radial direction at an inner peripheral portion of the first rotating body.

In the medicine cassette of the present invention, the first rotating body is arranged so as to be upwardly inclined from the bottom side toward the upper end side of the side-wall constituent body, that is the first rotating body is arranged so as to form a raising slope toward the side of the second rotating body. Further, the first rotating body is formed into a shape in which the gradient of the direction directed from the inner side toward the outer side of the radial direction at the outer peripheral portion is smaller than the gradient of the direction directed from the inner side toward the outer side of the radial direction at the inner peripheral portion of the first rotating body. Thus, the gradient of the first rotating body becomes gentle in the vicinity of the second rotating body. Therefore, according to the above-mentioned configuration, it is possible to smoothly transfer and place the medicines from the first rotating body onto the second rotating body.

Further, with the shape in which the gradient at the outer peripheral portion of the first rotating body is smaller than that at the inner peripheral portion like the present invention, it is possible to improve a setting angle (gradient) of the whole of the first rotating body. With this configuration, it is possible to suppress a square measure required for arranging the first rotating body to a minimum, thereby suppressing a width and a length of the medicine cassette and making the medicine cassette compact.

In addition, the medicine cassette of the present invention can perform rotation control for the first rotating body and the second rotating body to appropriately and smoothly discharge the medicines without relying on manual operations. Thus, by employing the medicine cassette of the present invention, it is possible to suppress occurrence of human errors caused by the manual operations to a minimum.

A medicine cassette of the present invention provided for solving the above-mentioned problem is characterized in that: the medicine cassette comprises a side-wall constituent body constituting a side-wall of a medicine containing part in which medicines should be contained, a first rotating body which is arranged so as to be inclined from a bottom side toward an upper end side of the side-wall constituent body and can rotate around a first rotational axis inclined with respect to an axial line of the side-wall constituent body, a second rotating body which is arranged on an upper-side outer periphery of the side-wall constituent body and which can rotate around a second rotational axis and a medicine discharging part for discharging the medicines, wherein the medicine cassette can transfer and place the medicines prepared in the medicine containing part onto the second rotating body due to a rotation of the first rotating body and transfer the medicines toward a downstream side of a rotational direction of the second rotating body to discharge the medicines from the medicine discharging part, wherein a gradient of a direction directed from an inner side toward an outer side of a radial direction of the first rotating body at an outer peripheral portion of the first rotating body is smaller than a gradient of the direction directed from the inner side toward the outer side of the radial direction at an inner peripheral portion of the first rotating body and wherein the first rotating body on the side of the medicine containing part is formed into a concave shape in an area on the inner side of the radial direction with respect to the outer peripheral portion.

The first rotating body employed in the medicine cassette of the present invention is formed into the concave portion on the side of the medicine containing part. Thus, according to the present invention, it is possible to improve the volume of the medicine containing part by an amount ensured by forming the first rotating body into the concave portion and make the medicine cassette compact.

Further, the medicine cassette of the present invention is formed into the shape in which the gradient at the outer peripheral portion of the first rotating body is smaller than that at the inner peripheral portion of the first rotating body. Thus, the gradient of the first rotating body becomes gentle in the vicinity of the second rotating body. Therefore, in the medicine cassette of the present invention, the transferring and placing of the medicines from the first rotating body onto the second rotating body is smoothly performed.

In addition, the medicine cassette of the present invention can perform rotational control for the first rotating body and the second rotating body to mechanically dispense the medicines. Thus, according to the medicine cassette of the present invention, it is possible to contribute to the suppression of the human errors caused by the manual operations.

Here, if a connecting portion for connecting the first rotating body to the side of a driving source is formed so as to protrude toward the inner side of the medicine containing part, the volume of the containing part decreases by an amount corresponding to a connecting structure. Further, if a protruding portion due to the connecting portion is positioned in the medicine containing part, there is concern that the protruding portion interferes when the medicines are collected from the medicine containing part. Specifically, there is concern that the medicines make contact with the protruding portion and bounce at the time of performing an operation for collecting the medicines by inclining the medicine cassette. Further, at the time of putting a hand into the medicine cassette for collecting the medicines, there is concern that the protruding portion interferes and thus work efficiency is deteriorated.

In the medicine cassette of the present invention provided for solving the above-mentioned problem, it is preferable that the connecting portion for connecting the first rotating body to the side of the driving source is arranged on an outer side of the medicine containing part.

In the medicine cassette of the present invention, the connecting portion is provided on the outer side of the medicine containing part. Namely, any protruding portion formed by providing the connecting portion does not exist on the first rotating body on the side of the medicine containing part. Thus, according to the present invention, it is possible to solve the above-mentioned problems concerned at the time of collecting the medicines from the medicine containing part.

It is preferable that the above-mentioned medicine cassette of the present invention has a cassette main body containing at least the side-wall constituent body, the first rotating body and the second rotating body, the medicines prepared in the medicine containing part can be collected from an opening portion formed on the upper end side of the side-wall constituent body and a guiding portion for guiding the medicines to be collected is provided on the cassette main body.

With this configuration, it is possible to provide the medicine cassette which can easily and smoothly perform the collecting operation for the medicines in the medicine containing part.

A medicine dispensing apparatus of the present invention is characterized in that: the medicine dispensing apparatus comprises the above-mentioned medicine cassette of the present invention, a base portion to which the medicine cassette can be attached and detached and a cassette connecting mechanism for connecting the medicine cassette to the base portion, wherein the medicine cassette includes a cassette main body containing at least the side-wall constituent body, the first rotating body and the second rotating body, wherein the medicine cassette can be attached to and detached from the base portion by sliding the cassette main body with respect to the base portion in a predetermined sliding direction, wherein the cassette connecting mechanism has engaging pieces provided on one of the sides of the cassette main body and the base portion, receiving portions provided on the other one of the sides of the cassette main body and the base portion and an engaging piece operating mechanism for operating the engaging pieces, wherein the plurality of engaging pieces and receiving portions are arranged so as to be spaced apart from each other in a direction crossing the sliding direction and wherein the engaging pieces can be engaged with and removed from the receiving portions by operating the engaging piece operating mechanism.

In the medicine dispensing apparatus of the present invention, the plurality of engaging pieces and receiving portions are provided so as to be spaced apart from each other in the direction crossing the sliding direction. Thus, according to the present invention, it is possible to provide the medicine dispensing apparatus in which the medicine cassette can be attached to the base portion with a correct posture without inclining with respect to the base portion.

Further, the medicine cassette used in the medicine dispensing apparatus of the present invention can mechanize the dispensing operation for the medicines by performing the rotation control for the first rotating body and the second rotating body. Thus, according to the medicine dispensing apparatus of the present invention, it is possible to contribute to the suppression of the human errors caused by the manual operations regarding the dispensing operation for the medicines.

It is preferable that the above-mentioned medicine cassette of the present invention has a cassette main body containing at least the side-wall constituent body, the first rotating body and the second rotating body and a cover body which can be opened and closed on the upper end side of the side-wall constituent body and the cover body is formed into a shape in which all or a part of an area adjacent to a front side of the cassette main body is cut so as to provide a cover-side insertion area into which fingers can be inserted from the front side toward a rear side of the cassette main body.

With this configuration, it is possible to provide the medicine dispensing apparatus which can easily perform the attaching and detaching operation for the cassette main body by inserting the fingers into the cover-side insertion area. Namely, even in a state that a plurality of medicine dispensing apparatuses are arranged in the vertical direction so as not to be spaced apart from each other, it is possible to take the cassette by inserting the fingers into the cover-side insertion area and clipping the cassette main body in the vertical direction with the fingers. Further, even at the time of clipping the cassette main body in the cover-side insertion area, the cover body can be opened and closed. Thus, it is possible to open and close the cover with clipping the cassette main body.

Further, in a case where a display part is provided at the cassette main body with an electronic paper and the like, since the display part is provided on the front side of the cassette in almost cases, it is difficult to attach a handle on the front side of the cassette main body from a point of view of visibility of the display part. Even in such a case, with the above-mentioned configuration, it becomes easier to attach and detach the cassette main body without deteriorating the visibility of the display part such as an electronic paper provided on the front side of the cassette main body.

It is preferable that the above-mentioned medicine dispensing apparatus of the present invention is characterized in that: the medicine dispensing apparatus comprises a medicine cassette and a base portion to which the medicine cassette can be attached and detached, wherein the medicine cassette includes a cassette main body containing at least the side-wall constituent body, the first rotating body and the second rotating body, wherein the base portion is formed into a shape in which all or a part of an area adjacent to a front side of the cassette main body is cut and wherein when another medicine cassette is arranged on the lower side of the base portion, a base-side insertion area into which fingers can be inserted between the other medicine cassette and the base portion from the front side toward a rear side of the cassette main body is provided in the base portion.

With this configuration, it is possible to provide the medicine dispensing apparatus which can easily perform the attaching and detaching of the cassette main body by inserting the fingers into the base-side insertion area existing between the base portion and the other cassette on the lower side of the base portion. Namely, even in a state that a plurality of medicine dispensing apparatuses are arranged so as not to be spaced apart from each other, it is possible to take the cassette by inserting the fingers into the base-side insertion area and clipping the cassette main body in the vertical direction with the fingers.

Further, in a case where a display part is provided at the cassette main body with an electronic paper and the like, since the display part is provided on the front side of the cassette in almost cases, it is difficult to attach a handle on the front side of the cassette main body from a point of view of visibility of the display part. Even in such a case, with the above-mentioned configuration, it becomes easier to attach and detach the cassette main body without deteriorating the visibility of the display part such as an electronic paper provided on the front side of the cassette main body.

Here, in the case of using the medicine cassette of the present invention like the above-mentioned medicine dispensing apparatus, the medicines scraped up by the first rotating body are in a state of being aligned on the second rotating body. If spaces between the medicines on the second rotating body are not sufficient, it is impossible to definitely say that there is no possibility that another medicine at a position subsequent to a medicine to be dispensed is also mistakenly dispensed.

A medicine dispensing apparatus of the present invention provided for solving the above-mentioned problem is characterized in that: the medicine dispensing apparatus comprises the above-mentioned medicine cassette of the present invention, a cassette control device for performing operation control for the medicine cassette and a discharging status determining device for determining a discharging status of the medicines in the medicine discharging part, wherein rotation control for reversely rotating the second rotating body by a predetermined amount is performed by the cassette control device every time when the discharging of the medicines is detected by the discharging status determining device along with a normal rotation of the second rotating body.

In the medicine dispensing apparatus of the present invention, the rotation control for reversely rotating the second rotating body by the predetermined amount is performed every time when the second rotating body is normally rotated and the discharging of the medicines is confirmed. By performing such rotation control, the spaces between the medicines on the second rotating body are expanded. With this configuration, it is possible to prevent the other medicine subsequent to the medicine to be dispensed from being mistakenly dispensed.

In the above-mentioned medicine dispensing apparatus of the present invention, it is preferable that the rotation control for the second rotating body is performed by the cassette control device so that a rotational speed at the time of a reverse rotation is higher than a rotational speed at the time of a normal rotation.

By performing the rotation control for the second rotating body like the present invention, it is possible to smoothly and reliably expand the spaces between the medicines on the second rotating body. With this configuration, it is possible to further suppress the possibility that the other medicine subsequent to the medicine to be dispensed is mistakenly dispensed.

A medicine dispensing apparatus of the present invention is characterized in that: the medicine dispensing apparatus comprises the above-mentioned medicine cassette of the present invention and a cassette control device for performing operation control for the medicine cassette, wherein the rotation control for the second rotating body is performed so that a rotational speed of the second rotating body in a time period from a timing at which it is expected that the medicines are transferred and placed from the medicine containing part onto the second rotating body due to the rotation of the first rotating body to a timing at which it is expected that the medicine located at a head position in a transferring direction among the medicines transferred and placed on the second rotating body and transferred to the side of the medicine discharging part reaches a predetermined position is higher than a rotational speed of the second rotating body after the medicine positioned at the head position in the transferring direction goes through the predetermined position.

The medicine dispensing apparatus of the present invention is configured to rotate the second rotating body in the time period from the timing at which it is expected that the medicines are transferred and placed on the second rotating body due to the rotation of the first rotating body to the timing at which it is expected that the medicine located at the head position in the transferring direction reaches the predetermined position with a high speed. Thus, according to the present invention, it is possible to significantly reduce a time required for dispensing the medicine located at the head position from the medicine cassette.

A medicine dispensing apparatus of the present invention is characterized in that: the medicine dispensing apparatus comprises the above-mentioned medicine cassette of the present invention and a discharging status determining device for determining a discharging status of the medicines at the medicine discharging part, wherein the medicines are detected by the transferred medicine detecting device in a state that the second rotating body rotates for longer than a predetermined time and wherein the discharging status determining device determines that a dispensing error of the medicines occurs on a condition that the discharging of the medicines is not detected by the discharging medicine detecting device.

With this configuration, it is possible to accurately perform the determination that the dispensing error of the medicine occurs.

It is preferable that the above-mentioned medicine dispensing apparatus of the present invention includes a cassette control device for performing operation control for the medicine cassette and execution control for a dispensing error solving operation for reversely rotating the second rotating body in a direction opposite to a discharging direction of the medicines is performed by the cassette control device on a condition that the discharging status determining device determines that the dispensing error of the medicine occurs.

By rotating the second rotating body in the reverse direction in the case where it is expected that the dispensing error of the medicine occurs like the present invention, a posture of the medicine is changed or the like and thus the dispensing error can be solved. Thus, according to the present invention, it is possible to provide the medicine dispensing apparatus which can solve the dispensing error without troubling hands of a user even in the case where the dispensing error of the medicine is concerned.

A medicine dispensing apparatus of the present invention is characterized in that: the medicine dispensing apparatus comprises the above-mentioned medicine cassette of the present invention and a remaining medicine determining device for determining a remaining possibility of the medicines in the medicine cassette, wherein the remaining medicine determining device determines that there is a possibility that the medicines remain in the medicine cassette on a condition that the second rotating body is rotated in a direction opposite to a discharging direction of the medicines after the dispensing of the medicines due to the medicine cassette is completed and the medicines are detected by the transferred medicine detecting device after a start of a reverse rotation of the second rotating body.

With this configuration, it becomes possible to identify the possibility that one of more of the medicines remain in the medicine cassette. This can improve convenience for a user.

Here, in the apparatus in which the transferred medicine detecting device which can detect the existence of the medicines transferred and placed on the second rotating medicine is provided as described above, if a medicine which does not exist on the second rotating body enters into a detection area of the transferred medicine detecting device when a number of medicines are contained in the medicine containing part or the like, there is a concern of mistakenly detecting that the medicine exists on the second rotating body.

A medicine dispensing apparatus of the present invention provided for solving the above-mentioned problem is characterized in that: the medicine dispensing apparatus comprises the above-mentioned medicine cassette of the present invention and a cassette control device for performing operation control for the medicine cassette, wherein the cassette control device performs a transferring and placing operation for rotating the first rotating body to transfer and place the medicines in the medicine containing part onto the second rotating body on a condition that the medicines are not detected by the transferred medicine detecting device and rotates the first rotating body with a lower speed than that at the time of the transferring and placing operation, stops or irregularly rotates the first rotating body on a condition that the medicines are detected by the transferred medicine detecting device.

The medicine dispensing apparatus of the present invention is configured to rotate, stop or irregularly rotate the first rotating body on the condition that the medicines are detected by the transferred medicine detecting device. With this configuration, it is possible to change the postures of the medicines in the medicine containing part and suppress the mistaken detection that the medicine in the medicine containing part exists on the second rotating body. Further, by rotating the first rotating body with the lower speed than that at the time of the transferring and placing operation, stopping or irregularly rotating the first rotating body, it is possible to suppress load applied to the medicines in the medicine containing part to a minimum and suppress breakage or abrasion of the medicines.

Here, it is preferable that a display device for displaying information such as a kind of the medicines contained in the medicine containing part is provided in the medicine dispensing apparatus. Further, with assuming that the medicines contained in the medicine containing part are changed, it is preferable that the display device is, for example, a liquid crystal display, an electronic paper or the like which can receive electric power to rewrite the information or the like. Here, in a case of using the display device which can utilize the electric power to rewrite the information or the like, it is preferable that a connection between the display device and a power supplying part is not mistakenly released in a rewriting operation or the like with considering of reliably allowing the display device to display necessary information and protecting the display device.

As a result of earnest investigation by the inventors from the point of view as described above, it has been found that a time (a rewriting time) required from the start to the end of transmitting display data for information display to the display device varies depending on a temperature condition (an environment temperature condition) of a location where the medicine dispensing apparatus is set. Based on such a phenomenon, the inventors have obtained knowledge that it is preferable to set the rewriting time based on the environment temperature condition and set a time period in which the connection between the display device and the power supplying part is not released.

A medicine dispensing apparatus of the present invention provided based on the above-mentioned knowledge has a medicine containing part in which medicines should be contained and can dispense the medicines prepared in the medicine containing part one by one based on prescription data, wherein the medicine dispensing apparatus has a display device provided on the medicine containing part, a display control device which can transmit display data used for allowing the display device to display information to the display device, a power supplying part electrically connected to the display device to supply electric power used for allowing the display device to display display-contents related to the display data to the display device, a connection keeping part for keeping a connected state between the power supplying part and the display device, a temperature detecting part which can detect a setting environment temperature and a connection control part for setting a rewriting time with using a start time of transmitting the display data by the display control device as a reference and controlling the connection keeping part so that the connection between the power supplying part and the display device is kept over the rewriting time and wherein the connection control part sets the rewriting time based on the detected temperature due to the temperature detecting part.

In the medicine dispensing apparatus of the present invention, the control for keeping the connection between the display device and the power supplying part according to the rewriting time set based on the environment temperature condition is performed by the connection control part. With this configuration, it becomes possible to reliably allow the display device to display the necessary information and protect the display device.

A medicine packaging apparatus of the present invention is characterized in that: the medicine packaging apparatus comprises the above-mentioned medicine cassette of the present invention or the above-mentioned medicine dispensing apparatus of the present invention and a packaging part for packaging the medicines dispensed from the medicine cassette.

According to the present invention, it is possible to provide the medicine packaging apparatus which can suppress the occurrence of the human errors caused by the manual operations to a minimum and smoothly dispense and package the medicines with a minimum space.

According to the present invention, it is possible to provide the medicine cassette, the medicine dispensing apparatus and the medicine packaging apparatus which can suppress the occurrence of the human errors caused by the manual operations using the manually distributing part or the like and smoothly dispense the medicines with the minimum space.

DETAILED DESCRIPTION OF THE INVENTION

Hereinafter, detailed description will be given to a medicine packaging apparatus 10 according to one embodiment of the present invention and a medicine dispensing apparatus 55 and a medicine cassette 100 used in the medicine packaging apparatus 10 with reference to the accompanying drawings. In this regard, although terms for indicating a specific direction or position (for example, terms including "upper", "lower", "side" and "end") are used in the following description as needed, the use of these terms is intended to facilitate the understanding of the present invention with reference to the drawings and the technical scope of the present invention is not limited by the meaning of these terms. Further, the following explanation merely provides examples in essence and is not intended to limit the present invention, an application of the present invention or an intended user of the present invention.

Figure 1B:
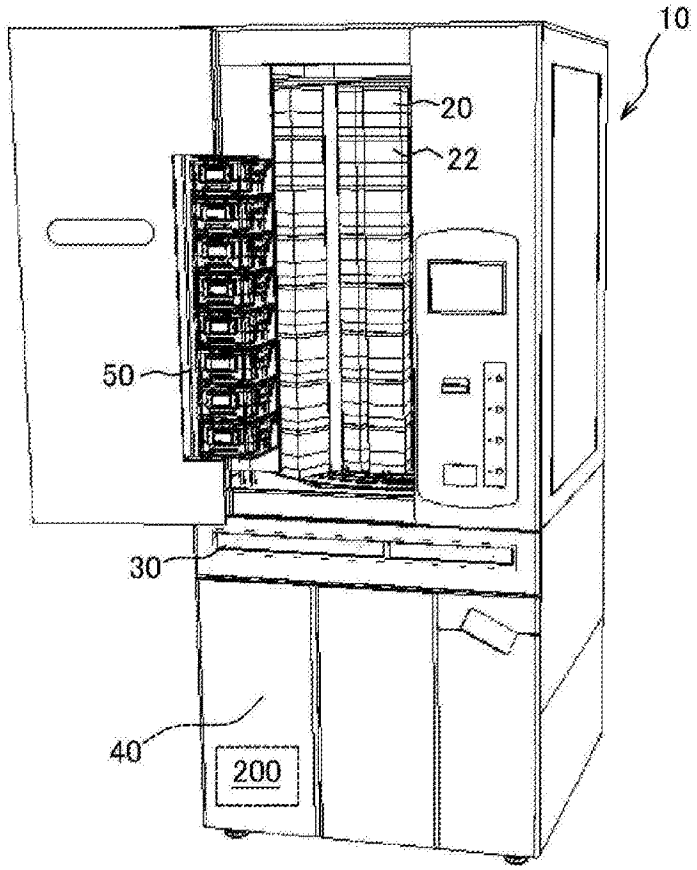
FIG. 1A is a perspective view showing an outline of a medicine packaging apparatus according to the present embodiment and FIG. 1B is a perspective view showing a state that a door is opened.
Figure 1A:
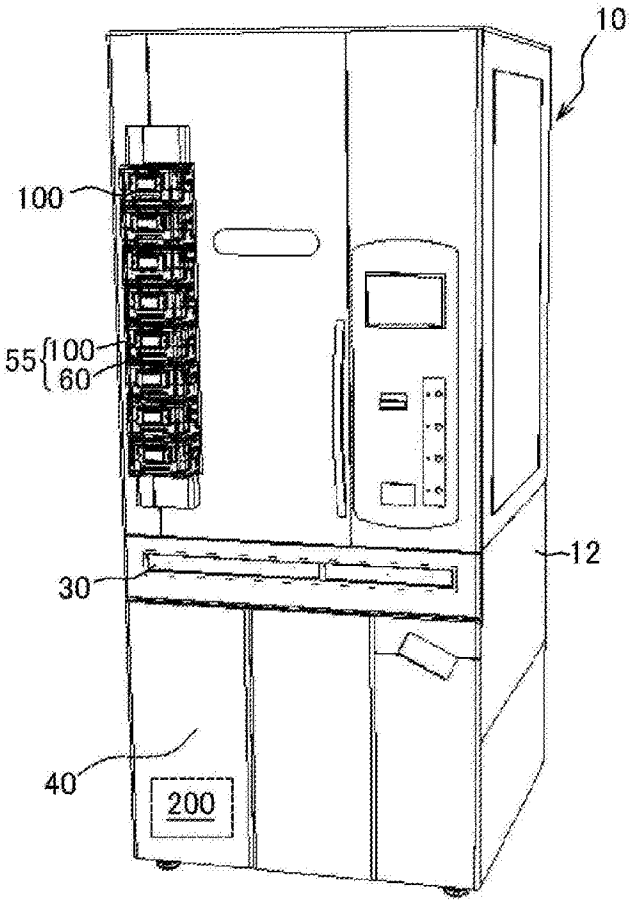

FIG. 1A and FIG. 1B are schematic view of the medicine packaging apparatus 10 according to this embodiment. The medicine packaging apparatus 10 is configured so that a plurality of first medicine supplying parts 20, a manually distributed medicine supplying part 30, a packaging part 40 and a second medicine supplying part 50 are provided at an apparatus main body 12. Each part constituting the medicine packaging apparatus 10 is configured to be driven and controlled by a control device 200.

As shown in FIG. 1B, the first medicine supplying parts 20 are provided on an inner side of a door 14 provided on the front side of the apparatus main body 12. The first medicine supplying parts 20 are conventionally known and formed by arranging a plurality of medicine cassettes 22 in the apparatus main body 12 along the vertical and horizontal directions. A plurality of medicines are contained in each medicine cassette 22 according to kinds of the medicines (hereinafter, when the word of "medicine(s)" is used, this mainly means a tablet but also contains a capsule medicine or the like). Based on prescription data or the like, the medicines are discharged from the corresponding first medicine supplying part 20 by a predetermined amount.

The manually distributed medicine supplying part 30 is used for setting half-tablet medicines or medicines whose use frequency is low in each area formed in a grid pattern with manual distribution and utilized for packaging these medicines with the packaging part 40. By pulling the manually distributed medicine supplying part 30 toward the near side on the front side of the apparatus main body 12, the manually distributed medicine supplying part 30 is brought into a state that the medicines can be manually distributed. By returning the manually distributed medicine supplying part 30 into the apparatus main body 12 after preparing the medicines into the manually distributed medicine supplying part 30 with the manual distribution, it becomes possible to dispense the medicines prepared by the manual distribution according to the prescription in sequence.

The packaging part 40 rewinds and supplies packaging paper wound around a roll to package the medicines supplied from each of the medicine cassettes 22 or the manually distributed medicine supplying part 30 for one package. The packaging part 40 is arranged in a space in the apparatus main body 12 and on the lower side of the manually distributed medicine supplying part 30.

The second medicine supplying part 50 contains and uses medicines whose use frequency is low, medicines to be counted or the like. The second medicine supplying part 50 includes the medicine dispensing apparatus 55. Although the medicine dispensing apparatus 55 may be single, a plurality of medicine dispensing apparatuses 55 (in this embodiment, the number of the medicine dispensing apparatuses 55 is eight) are provided as shown in FIG. 1A. Although an arrangement of the medicine dispensing apparatuses 55 in the second medicine supplying part 50 may be appropriately set, the medicine dispensing apparatuses 55 are arranged so as to be aligned in the vertical direction in this embodiment. The second medicine supplying part 50 is provided on the front side of the apparatus main body 12 so as to be exposed toward the outside. Thus, it is possible to attach or detach the medicine cassette 100 constituting the medicine dispensing apparatus 55 and perform a restocking operation into the medicine cassette 100, a replacing operation for the medicines or the like even if the door 14 is not opened unlike the second medicine supplying parts 50 or the door 14 is kept to be opened.

Figure 2:
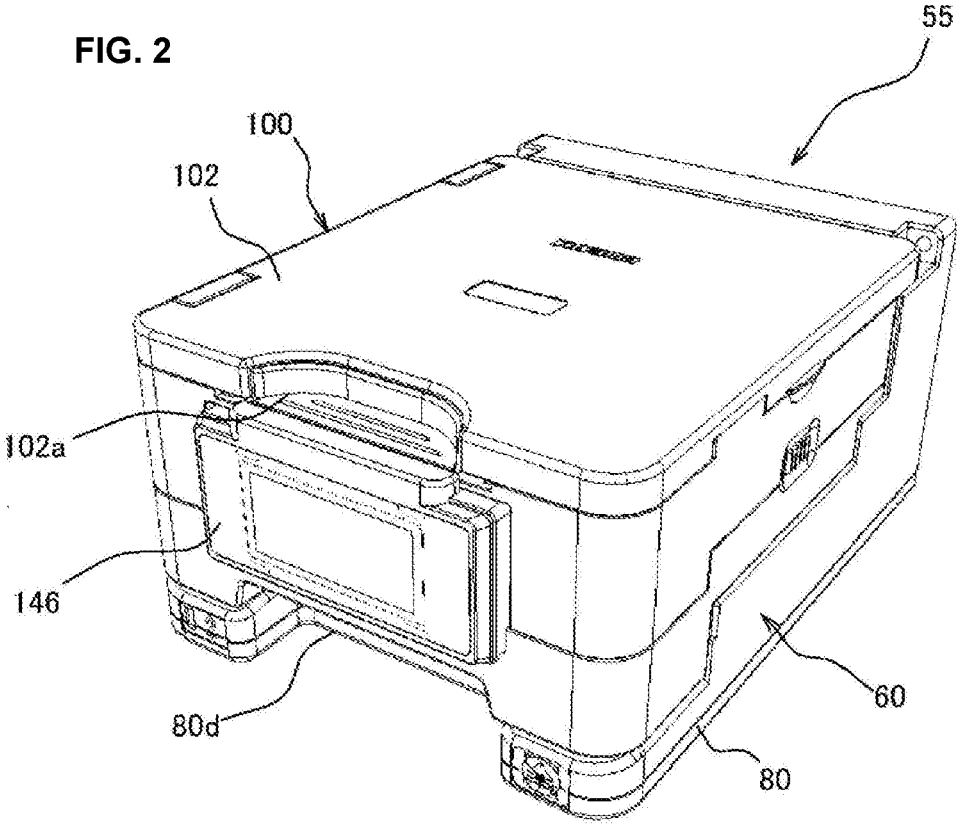
FIG. 2 is a perspective view of a medicine dispensing apparatus.
Figure 3:
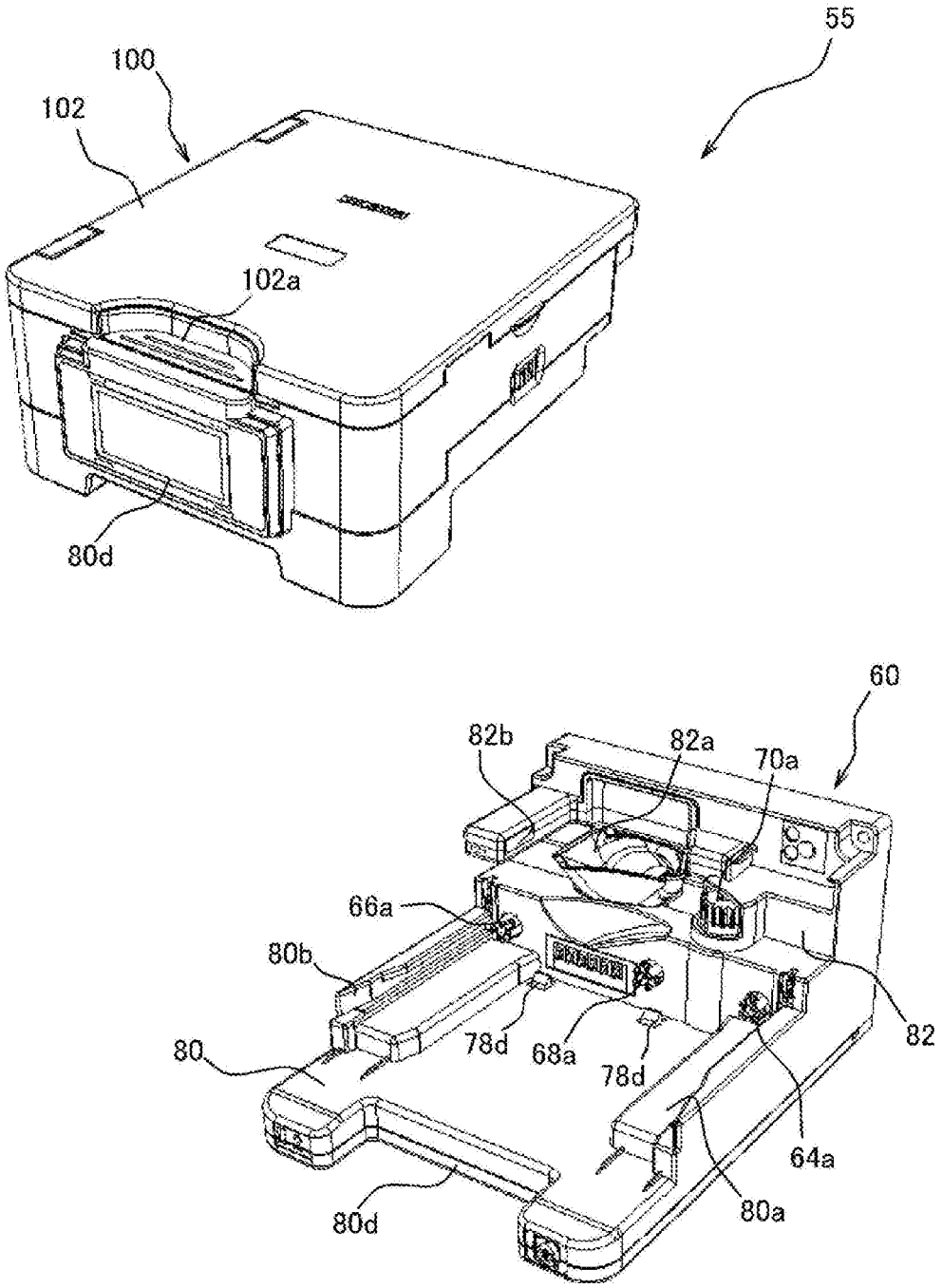
FIG. 3 is an exploded perspective view of the medicine dispensing apparatus shown in FIG. 2.

As shown in FIG. 2 and FIG. 3, the medicine dispensing apparatus 55 is constituted of a base portion 60 and the medicine cassette 100 which can be attached to or detached from the base portion 60.

Figure 4:
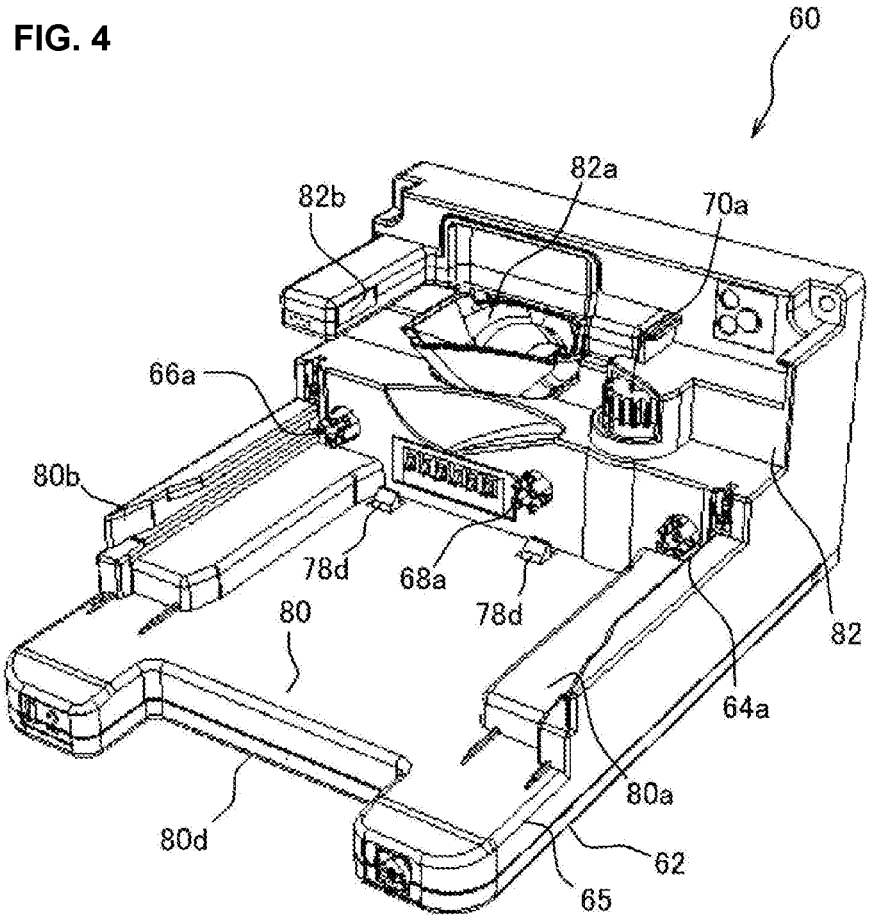
FIG. 4 is a perspective view showing a base portion constituting the medicine dispensing apparatus shown in FIG. 3.
Figure 5:
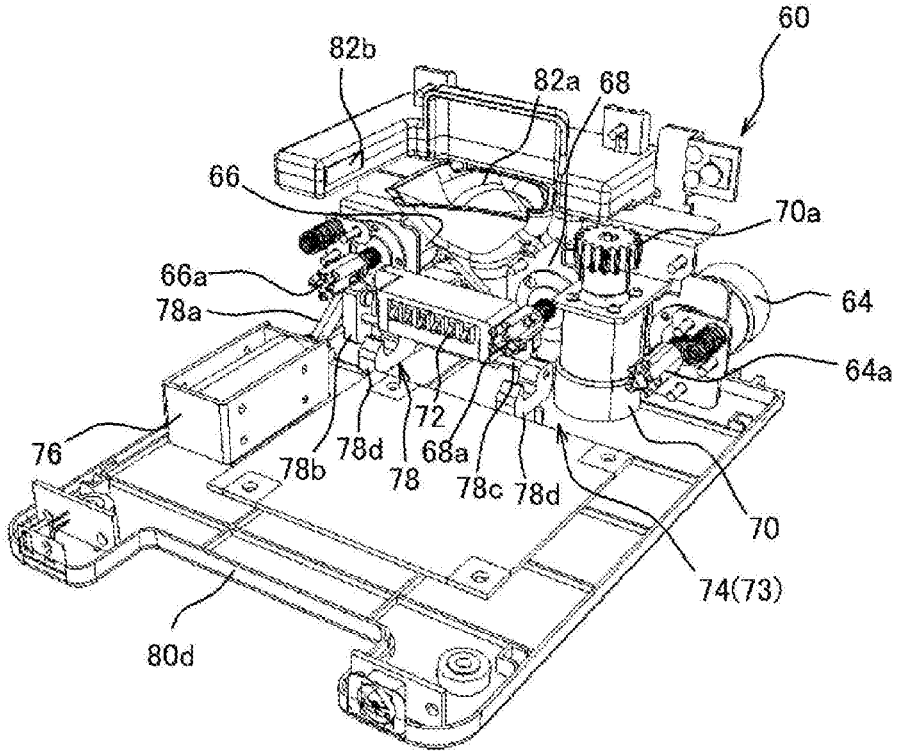
FIG. 5 is a perspective view showing an internal structure of the base portion shown in FIG. 4.

As shown in FIG. 4 and FIG. 5, the base portion 60 includes a base main body 62, a plurality of constituent parts such as motors attached to the base main body 62 and a base cover 65. As shown in FIG. 4, the base main body 62 is a plate-like member formed with a synthetic resin material. Further, as shown in FIG. 5, a first motor 64, a second motor 66, a third motor 68, a fourth motor 70, power supplying parts 72, a cassette locking part 74 and the like are provided on the base main body 62.

The first motor 64 is used as a driving force source for a height restricting body 160 provided on the side of the after-mentioned medicine cassette 100. The first motor 64 is embedded in an area on the rear side of the base portion 60 (a rear portion 82). The first motor 64 is arranged so that a rotational axis thereof extends from the rear side toward the front side of the base portion 60. A first driving gear 64*a* is attached to a tip end portion of the rotational axis of the first motor 64.

The second motor 66 is used as a driving force source for a width restricting body 170 provided on the side of the after-mentioned medicine cassette 100. The second motor 66 is embedded in the rear-side portion 82 of the base portion 60 as is the case for the first motor 64 and arranged so that a rotational axis thereof extends from the rear side toward the front side. A second driving gear 66*a* is attached to a tip end portion of the rotational axis of the second motor 66.

The third motor 68 is used as a driving force source for normally and reversely rotating the first rotating body 120 provided on the side of the after-mentioned medicine cassette 100. The third motor 68 is embedded in the rear-side portion 82 of the base portion 60 and arranged so that a rotational axis thereof extends from the rear side toward the front side. A third driving gear 68*a* is attached to the rotational axis of the third motor 68.

The fourth motor 70 is used as a driving force source for normally and reversely rotating the second rotating body 130 provided on the side of the after-mentioned medicine cassette 100. The fourth motor 70 is embedded in the rear-side portion 82 of the base portion 60 and arranged so that a rotational axis thereof extends in the vertical direction. A fourth driving gear 70*a* is attached to the rotational axis of the fourth motor 70.

Each of the power supplying parts 72 (electric power supplying parts) is constituted of a terminal or the like which can supply electric power to the side of the medicine cassette 100 when the medicine cassette 100 is attached to the base portion 60 (for example, one of the power supplying parts 72 on the side of the medicine cassette 100 and the side of the base portion 60 may be constituted of a male-type terminal and the other one of the power supplying parts 72 may be constituted of a female-type terminal.). With this configuration, it is possible to supply the electric power to the side of the after-mentioned medicine cassette 100 through the power supplying parts 72 when the medicine cassette 100 is attached to the base portion 60.

The cassette locking part 74 is combined with receiving portions 142*x*, 142*x* provided on the side of the after-mentioned medicine cassette 100 to constitute a cassette connecting mechanism 73 for locking the medicine cassette 100 attached to the base portion 60 so that the medicine cassette 100 cannot be released. The cassette locking part 74 includes an actuator 76 and an operating part 78. The actuator 76 is used for operating the operating part 78 and can be constituted of a solenoid or the like, for example. The operating part 78 includes a connecting portion 78*a*, a pivotally moving portion 78*b*, a support axis 78*c* and a plurality of engaging pieces 78*d*, 78*d* (in this embodiment, the number of the engaging pieces is two). The connecting portion 78*a*, the pivotally moving portion 78*b* and the support axis 78*c* constitute an engaging piece operating mechanism 78*e* for operating the engaging pieces 78*d*, 78*d*.

The connecting portion 78*a* is a piece-shaped member for connecting the actuator 76 and the pivotally moving portion 78*b*. Further, the pivotally moving portion 78*b* is a member to which the support axis 78*c* is connected and can be rotated around an axial center position of the support axis 78*c* integrally with the support axis 78*c*. The support axis 78*c* is an axial body arranged so as to extend in a direction crossing (in this embodiment, so as to extend in a direction substantially perpendicular to) a width direction of the base portion 60, that is a sliding direction at the time of attaching the medicine cassette 100 to the base portion 60. The engaging pieces 78*d*, 78*d* are arranged on the support axis 78*c* so as to be spaced apart from each other.

The cassette locking part 74 can drive the actuator 76 to pivotally move the pivotally moving portion 78*d* and the support axis 78*c* for moving up and down the engaging pieces 78*d*, 78*d*. With this configuration, it is possible to allow the engaging pieces 78*d*, 78*d* to respectively protrude from or return into openings provided in a bottom-side portion 80 of the base portion 60. With this configuration, it is possible to respectively engage or release the engaging pieces 78*d*, 78*d* to the receiving portions 142*x*, 142*x* provided on a bottom surface of the medicine cassette 100 attached to the base portion 60.

As shown in FIG. 4, the base cover 65 is constituted of the bottom-side portion 80 and a rear-side portion 82. Guide portions 80*a* extending in the front-rear direction are respectively formed on both sides of the bottom-side portion 80. A cassette bottom portion 142 of the after-mentioned medicine cassette 100 is guided by inner surfaces of the guide portions 80*a*. Auxiliary walls 80*b* further extending toward the upper side are respectively formed on upper-side outer edges of the guide portions 80*a*. Guide receiving pieces 80*c* respectively protrude from the auxiliary walls 80*b* toward the inner side and the cassette bottom portion 142 of the medicine cassette 100 is guided by the guide receiving pieces 80*c*. Further, a base-side insertion area 80*d* for allowing the medicine cassette 100 to be easily clipped by inserting fingers from a front-end portion of the medicine cassette 100 is formed in a front-side center of the bottom-side portion 80. Although the base-side insertion area 80*d* can be formed by a recess, a cutout or the like, the base-side insertion area 80*d* is formed by a cutout opening in the front side of the medicine dispensing apparatus 55 and concaved from the front side toward the rear side in this embodiment. Further, the openings from which the engaging pieces 78*d*, 78*d* of the above-mentioned cassette locking part 74 can protrude are formed in the base cover 65 in the vicinity of a boundary between the bottom-side portion 80 and the rear-side portion 82.

As shown in FIG. 3 and FIG. 4, the first driving gear 64*a*, the second driving gear 66*a*, the third driving gear 68*a* and the fourth driving gear 70*a* are exposed from the rear-side portion 82. Further, a hopper 82*a* for guiding the medicines dispensed from the medicine cassette 100 is attached to the rear-side portion 82. In this regard, this hopper 82*a* may be fixed to the medicine cassette 100. Further, the medicines dispensed into the hopper 82*a* are detected and counted by the discharged medicine detecting device 82*b*.

An optical sensor is used as the discharged medicine detecting device 82*b* and an optical path is set on the lower side than an upper surface of the second rotating body 130 by a predetermined length (for example, 1 mm) as shown in FIG. 4. Namely, when a position of the center of gravity of the medicine is moved from the upper surface of the second rotating body 130 to a drop position, the inclination of the medicine can be detected. With this configuration, in the case of counting the number of the medicines, since it is possible to stop the rotation of the second rotating body 130 at the time of confirming the discharging of the last medicine, it becomes possible to reliably prevent a subsequent medicine from being discharged.

Figure 6:
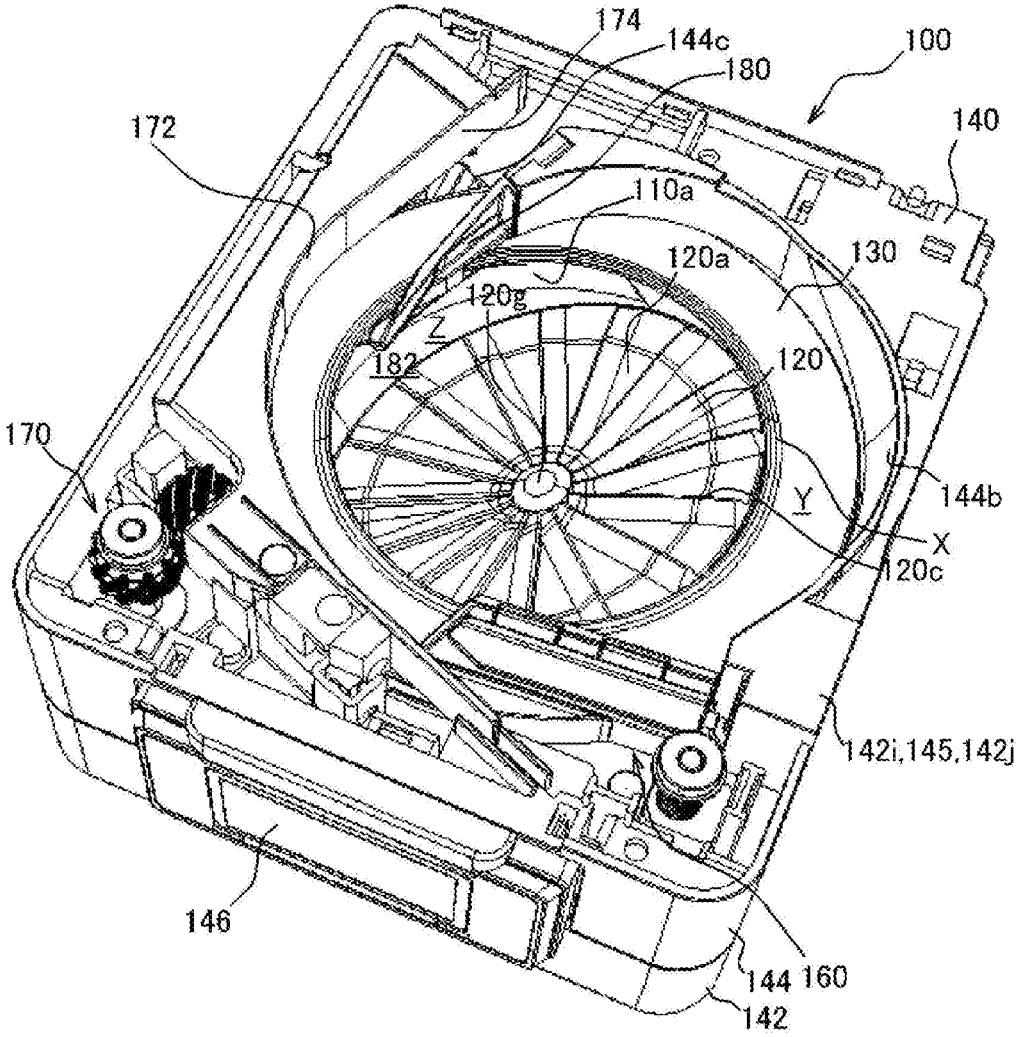
FIG. 6 is a perspective view showing a state that a cover body is removed from a medicine cassette constituting the medicine dispensing apparatus shown in FIG. 3.
Figure 7:
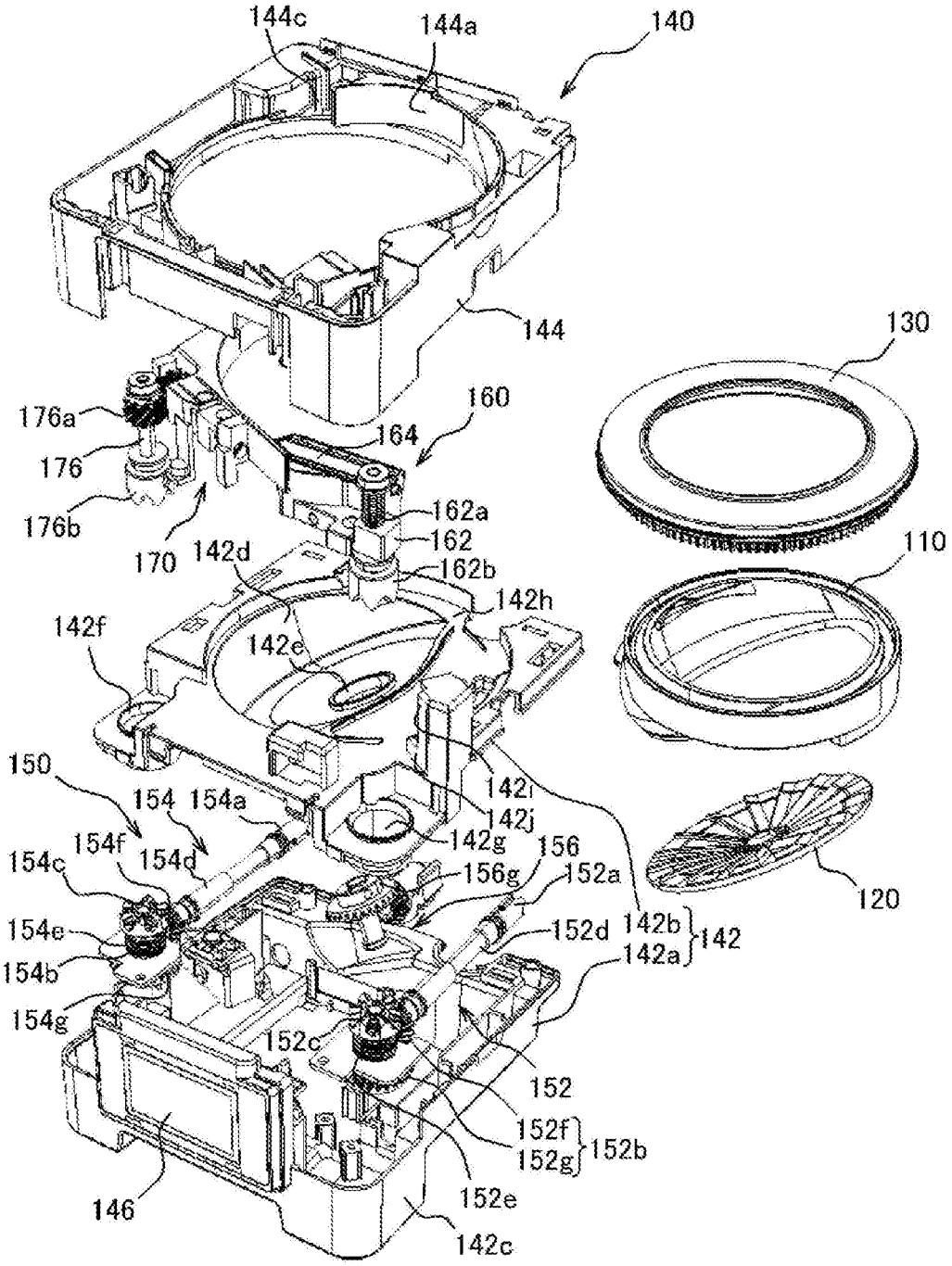
FIG. 7 is an exploded perspective view of the medicine cassette shown in FIG. 6.

As shown in FIG. 6 and FIG. 7, the medicine cassette 100 is formed by containing the side-wall constituent body 110 in the cassette main body 140, arranging the first rotating body 120 in a lower-end opening portion of this side-wall constituent body 110 and arranging the second rotating body 130 on an outer periphery of the upper-end opening portion of the side-wall constituent body 110. Further, the medicine cassette 100 has a cassette driving mechanism 150, the height restricting body 160, the width restricting body 170 and the like in the cassette main body 140. An upper-side opening portion of the medicine cassette 100 is closed by the cover body 102 (see FIG. 3).

As shown in FIG. 6 and FIG. 7, the cassette main body 140 includes the cassette bottom portion 142 and a cassette body portion 144.

Figure 8A:
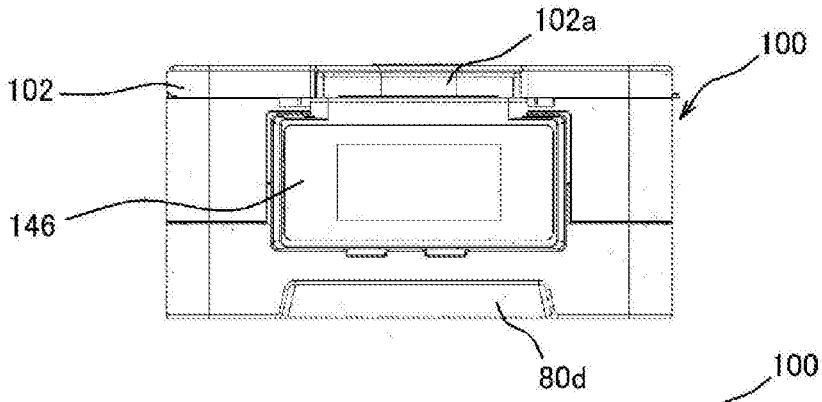
FIG. 8A is a front view of the medicine cassette shown in FIG. 6.
Figure 8B:
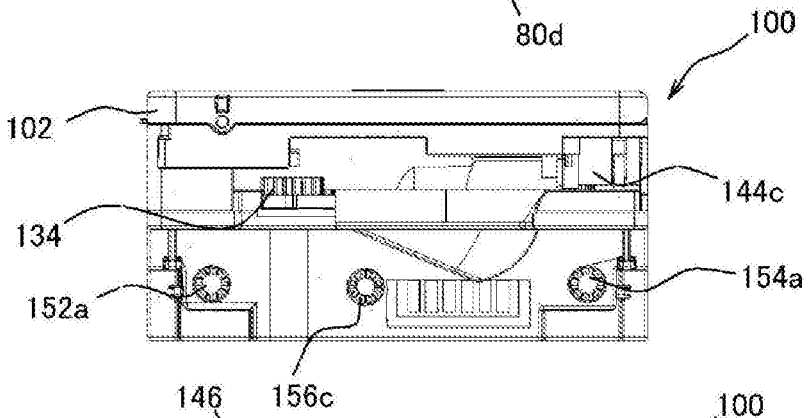
FIG. 8B is a rear view of the medicine cassette shown in FIG. 6
Figure 8C:
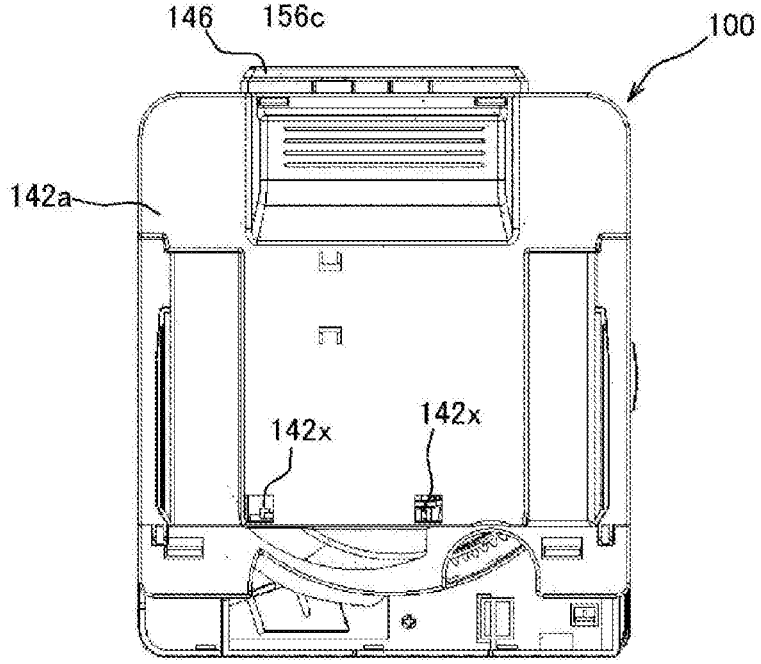
FIG. 8C is a bottom view of the medicine cassette shown in FIG. 6.

As shown in FIG. 7, the cassette bottom portion 142 is constituted by combining a bottom portion main body 142*a* and a bottom portion cover body 142*b*. Both side portions of the bottom portion main body 142*a* extend toward the upper side to constitute a lateral portion 142*c* guided by the guide portions 80*a* of the base portion 60. The bottom portion main body 142*a* is formed into a box-like shape having a bottom and whose upper side is opened and a space for containing the cassette driving mechanism 150 is formed in the bottom portion main body 142*a*. As shown in FIG. 8C, the plurality of receiving portions 142*x*, 142*x* (in this embodiment, the number of the receiving portions is two) are provided on the rear side of the bottom portion main body 142*a*. The receiving portions 142*x*, 142*x* are concave portions which can be respectively engaged with the engaging pieces 78*d*, 78*d* of the cassette locking part 74 provided on the side of the base portion 60. The receiving portions 142*x*, 142*x* are combined with the above-mentioned cassette locking part 74 on the side of the base portion 60 to constitute the cassette connecting mechanism 73.

The bottom portion cover body 142*b* is a cover-like member for closing the opening portion of the upper side of the bottom portion main body 142*a*. A cylindrical body arrangement portion 142*d*, openings 142*e*, 142*f*, 142*g*, a second rotating body arrangement portion 142*h*, a sensor arrangement portion 142*i*, a rotating guide portion 142*j* and the like are provided on the bottom portion cover body 142*b*.

The cylindrical body arrangement portion 142*d* is a concave portion having a size and a shape for enabling the side-wall constituent body 110 to be fitted thereto. The opening 142*e* is formed in a bottom surface of the cylindrical body arrangement portion 142*d*. The opening 142*e* is used for exposing a driving force transmission portion 156 constituting the cassette driving mechanism 150. Further, the openings 142*f*, 142*f* are used for respectively exposing a first output gear 152*c* and a second output gear 154*c* constituting the cassette driving mechanism 150.

Further, the second rotating body arrangement portion 142*h* is used for arranging the second rotating body 130. The second rotating body arrangement portion 142*h* is a concave portion provided so as to surround the cylindrical body arrangement portion 142*d* on the upper-end side of the cylindrical body arrangement portion 142*d*. The second rotating body arrangement portion 142*h* is curved into a shape along an annular outer edge of the second rotating body 130.

The sensor arrangement portion 142*i* is provided for arranging a transferred medicine detecting body 145 (a transferred medicine detecting device). The sensor arrangement portion 142*i* is provided at a position adjacent to the outer periphery side of the second rotating body arrangement portion 142*h*. The sensor arrangement portion 142*i* is provided in a riding-over side area Y which is described later in detail and provided at an after-mentioned medicine riding-over position X or a position on a downstream side of a transferring direction of the medicines due to the second rotating body 130 with respect to the riding-over position X.

The transferred medicine detecting body 145 is configured to be capable of detecting the medicines in a transfer path to a medicine discharging part 144*c* after the medicines prepared in the medicine containing part 182 are transferred and placed from the first rotating body 120 onto the second rotating body 130. Although the transferred medicine detecting body 145 may be any device as long as it can detect the medicines, the transferred medicine detecting body 145 can be constituted of a sensor such as an optical sensor, for example.

The rotating guide portion 142*j* is used for guiding the second rotating body 130 so that the second rotating body 130 can rotate without floating up and with keeping a substantially horizontal posture in a state that the second rotating body 130 is attached to the cassette main body 140. Although the rotating guide portion 142*j* may be any portion as long as it can prevent the floating of the second rotating body 130, the rotating guide portion 142*j* is constituted of a concave portion provided at a portion provided to stand for constituting the above-mentioned sensor arrangement portion 142*i* and on the lower side of the sensor arrangement portion 142*i*.

As shown in FIG. 7, a front-end portion of the cassette bottom portion 142 extends toward the upper side and is configured so that a display panel 146 (a display device) can be attached to the front-end portion of the cassette bottom portion 142. Although the display panel 146 may be any member such as a liquid crystal panel which can electronically display information, a piece of paper and a resin plate as long as it can display information, an electronic paper is used as the display panel 146 in this embodiment. Here, the electronic paper is a device which requires electric power for rewriting display-contents and does not require electric power in a displaying state. Further, the electronic paper is configured to display a variety of display data containing a name and the number of the medicines to be contained in the medicine cassette 100 based on the prescription data and a patient name or the like if needed. With this configuration, the user can identify the medicines contained in the medicine cassette 100 at a glance. In addition, by displaying the name and the number of the medicines in a rewritable manner, it is possible to flexibly respond to a change of the medicines or the like. Further, even in a case of restocking the medicines, it is possible to progress operations after confirming the contents displayed on the electronic paper.

By the way, the electronic paper requires a little time for rewriting the contents after the display data is inputted. Thus, in this embodiment, a power storage device (not shown in the drawings) such as a rechargeable secondary battery and a condenser or a hand-held type power supply source such as a primary battery is provided and this battery (or the condenser) can be recharged while the medicine cassette 100 is attached to the base portion 60. Further, even if the medicine cassette 100 is removed from the base portion 60 immediately after a signal is inputted to the electronic paper, it is possible to supply the electric power from the power storage device or the like to the electronic paper to rewrite the contents. By operating the cassette locking part 74 to release the locked state during a predetermined time required from the start to the end of inputting the display data, the medicine cassette 100 can be removed from the base portion 60. It is needed to only store the time period until the lock is released in this case in storage means (not shown in the drawings) of the side of the apparatus main body 1 in advance.

As described above, according to the medicine cassette 100 having the above configuration, it is possible to quickly remove the medicine cassette 100 from the base portion 60 when the display data is inputted and perform a restock operation of the medicines and the like even though the electronic paper is used. Since consumed power in the electronic paper is zero in the state that the cassette medicine 100 is removed, it is possible to display the display data without any problems even though the power storage device such as a battery and a condenser is used. Further, it is possible to progress the operations such as an operation for restocking the corresponding medicines according to the displayed contents. In this regard, although the configuration in which the hand-held type power supply source such as a battery is provided is exemplified in this embodiment, the present invention may take a configuration having no power supply source as described above.

As shown in FIG. 7, the cassette driving mechanism 150 is arranged on the inner side of the cassette bottom portion 142. The cassette driving mechanism 150 includes a height restricting body driving force transmission portion 152, a width restricting body driving force transmission portion 154 and the driving force transmission portion 156. These portions are respectively used for transmitting driving force to the height restricting body 160, the width restricting body 170 and the first rotating body 120.

The height restricting body driving force transmission portion 152 is used for transmitting driving force to the side of the height restricting body 160 with a path from a first driven gear 152*a* to the first output gear 152*c* through a first relay portion 152*b*. A first driving force transmission axis 152*d* extending from the rear side to the front side connects between the first driven gear 152*a* and the first relay portion 152*b*. The first driven gear 152*a* is a gear which can engage with the first driving gear 64*a* provided on the side of the base portion 60. Further, a first output axis 152*e* provided to stand on the front side connects between the first relay portion 152*b* and the first output gear 152*c*. The first relay portion 152*b* includes bevel gears 152*f*, 152*g* connected with the first driving force transmission axis 152*d* and the first output axis 152*e* and the driving force can be transmitted through both members.

The width restricting body driving force transmission portion 154 has the same configuration as the height restricting body driving force transmission portion 152. The width restricting body driving force transmission portion 154 is used for transmitting driving force to the side of the width restricting body 170 with a path from a second driven gear 154*a* to the second output gear 154*c* through a second relay portion 154*b*. A second driving force transmission axis 154*d* arranged in substantially parallel with the first driving force transmission axis 152*d* connects between the second driven gear 154*a* and the second relay portion 154*b*. The second driven gear 154*a* is a gear which can engage with the second driving gear 66*a* provided on the side of the base portion 60. Further, a second output axis 154*e* provided to stand on the front side connects between the second relay portion 154*b* and the second output gear 154*c*. The second relay portion 154*b* includes bevel gears 154*f*, 154*g* connected with the second driving force transmission axis 154*d* and the second output axis 154*e* and the driving force can be transmitted through both members.

Figure 16:
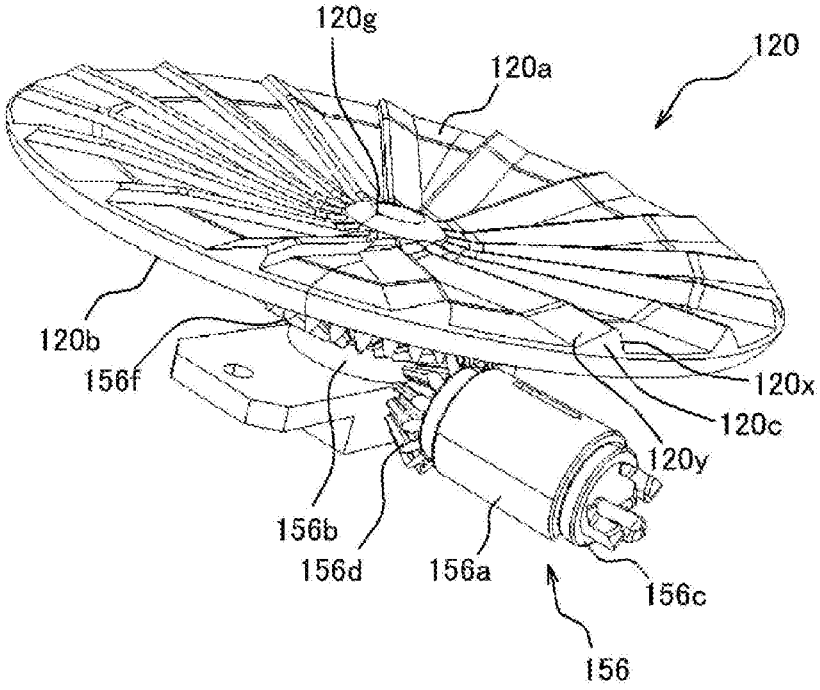
FIG. 16 is a perspective view showing the first rotating body and a driving force transmission part.

As shown in FIG. 7 and FIG. 16, the driving force transmission portion 156 has a driving force transmission axis 156*a* and a connecting axis 156*b*. A third driven gear 156*c* is provided on one end side of the driving force transmission axis 156*a* and a first intermediate gear 156*d* is provided on the other end side of the driving force transmission axis 156*a*. The third driven gear 156*c* is coupled with the third driving gear 68*a* provided on the side of the base portion 60. The connecting axis 156*b* is rotatably supported by a bearing 156*e* (omitted in FIG. 6) in a state that the connecting axis 156*b* is inclined by a predetermined angle. The connecting axis 156*b* is inclined with respect to the rotational axis (the axial line) of the side-wall constituent body 110 or the second rotating body 130 described later in detail by a predetermined angle. A second intermediate gear 156*f* is provided at the middle of the connecting axis 156*b* and engages with the first intermediate gear 156*d*. Although each of the first intermediate gear 156*d* and the second mediate gear 156*f* may be any gear, both of the first intermediate gear 156*d* and the second mediate gear 156*f* are constituted by bevel gears in this embodiment. Further, a connecting portion 156*g* is provided on an upper-end portion of the connecting axis 156*b*. The connecting portion 156*g* is a portion inserted into and connected to a connecting portion 120*e* provided on a lower-side portion 120*b* of the after-mentioned first rotating body 120. The connecting portion 156*g* is formed with a magnet or a material made of a magnetic body and can attract and fix a connecting member 120*f* provided in the connecting portion 120*e* by magnetic power.

Figure 9:
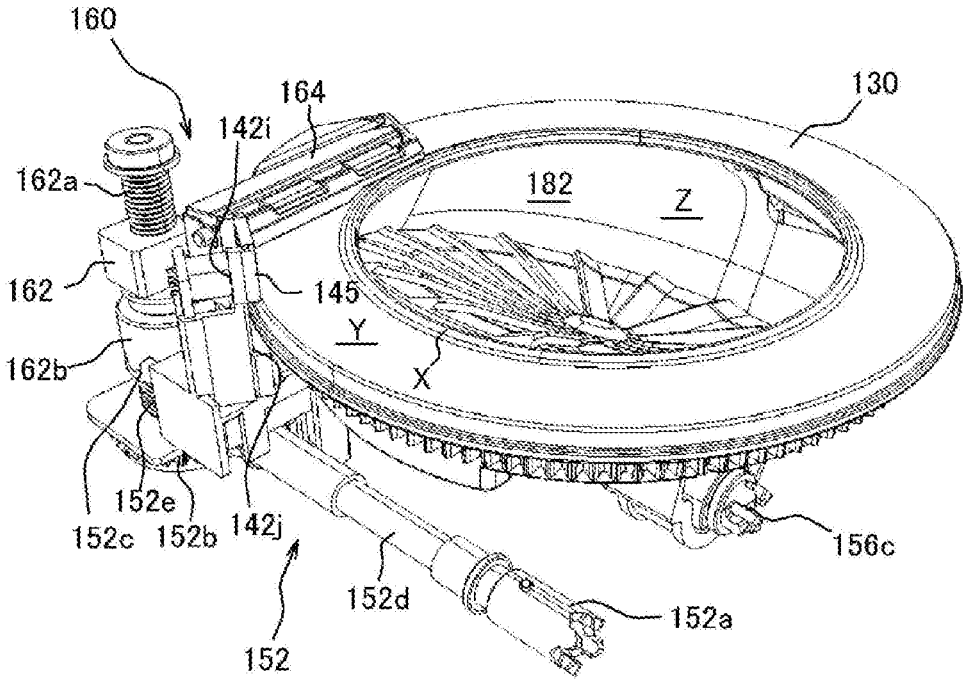
FIG. 9 is a perspective view showing a first rotating body, a second rotating body, a side-wall constituent body and a height restricting body shown in FIG. 6.
Figure 10:
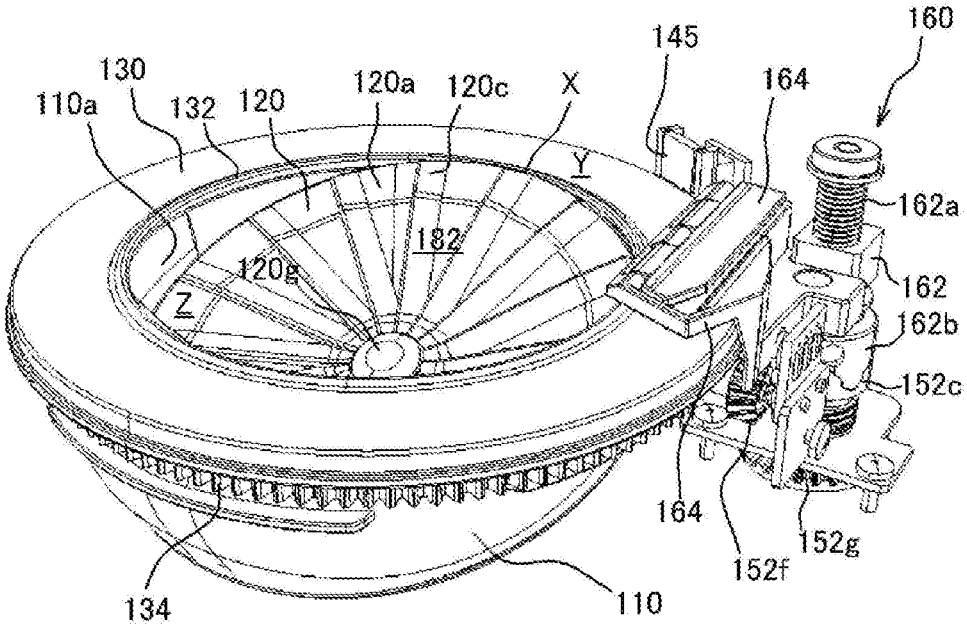
FIG. 10 is another perspective view showing the first rotating body, the second rotating body, the side-wall constituent body and the height restricting body shown in FIG. 9 viewed from another angle.
Figure 11:
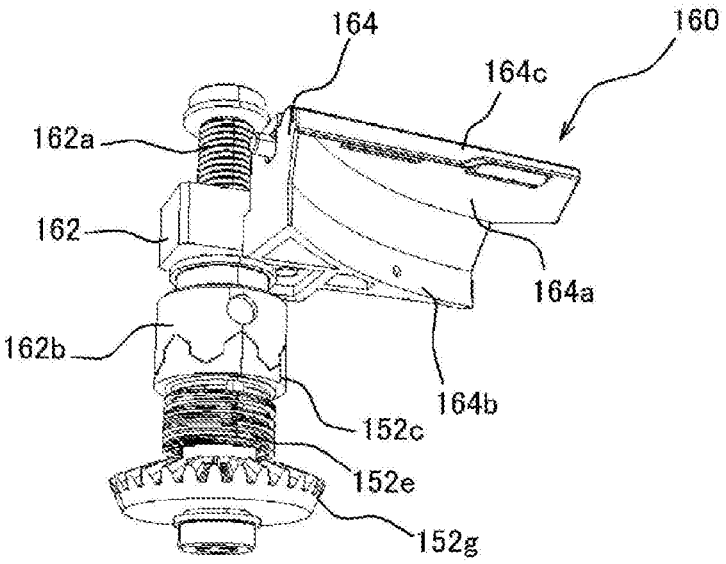
FIG. 11 is a perspective view showing a state that the height restricting body is viewed from a lower-side angle.

As shown in FIG. 9 to FIG. 11, the height restricting body 160 includes a connecting portion 162 and a height restricting portion 164 extending from this connecting portion 162. A female screw to be screwed with a male screw formed on an outer peripheral surface of a screw axis 162*a* is formed on the connecting portion 162. The screw axis 162*a* is provided to stand in a space formed in the cassette body portion 144. The height restricting portion 164 has a first guide plane 164*a* arranged with being spaced apart from the upper surface of the second rotating body 130 by a desired distance and a second guide plane 164*b* constituting a part of an outer peripheral surface of a medicine transfer path in a circumferential direction due to the second rotating body 130. A first input gear 162*b* is integrated with a lower-end portion of the screw axis 162*a*. The first input gear 162*b* meshes with the first output gear 152*c* through the above-mentioned opening 142*g*. With this configuration, the driving force outputted from the first motor 64 on the side of the base portion 60 is transmitted to the screw axis 162*a* through the height restricting body driving force transmission portion 152. Further, a screwing position between the male screw formed on the screw axis 162*a* and the female screw formed on the connecting portion 162 is changed and thus the height restricting body 160 is moved up and down. Then, a position of the first guide plane 164*a* with respect to the upper surface of the second rotating body 130 is adjusted. As a result, it is possible to take a state that a height through which the medicines transferred in the circumferential direction by the second rotating body 130 can pass is restricted by the height restricting body 160.

Further, an auxiliary piece 164*c* is attached to an upper surface of the height restricting portion 164 so that the auxiliary piece 164*c* can pivotally move around a support axis. The auxiliary piece 164*c* is biased so as to stand up from the upper surface of the height restricting portion 164 by a spring (not shown in the drawings) provided on the support axis. With this configuration, when the height restricting body 160 is moved to the lower side, the auxiliary piece 164*c* can be stood up by bias force of the spring to prevent the medicines from entering into a clearance caused between the upper surface of the height restricting portion 164 and a lower surface of the cover body 102.

Figure 12:
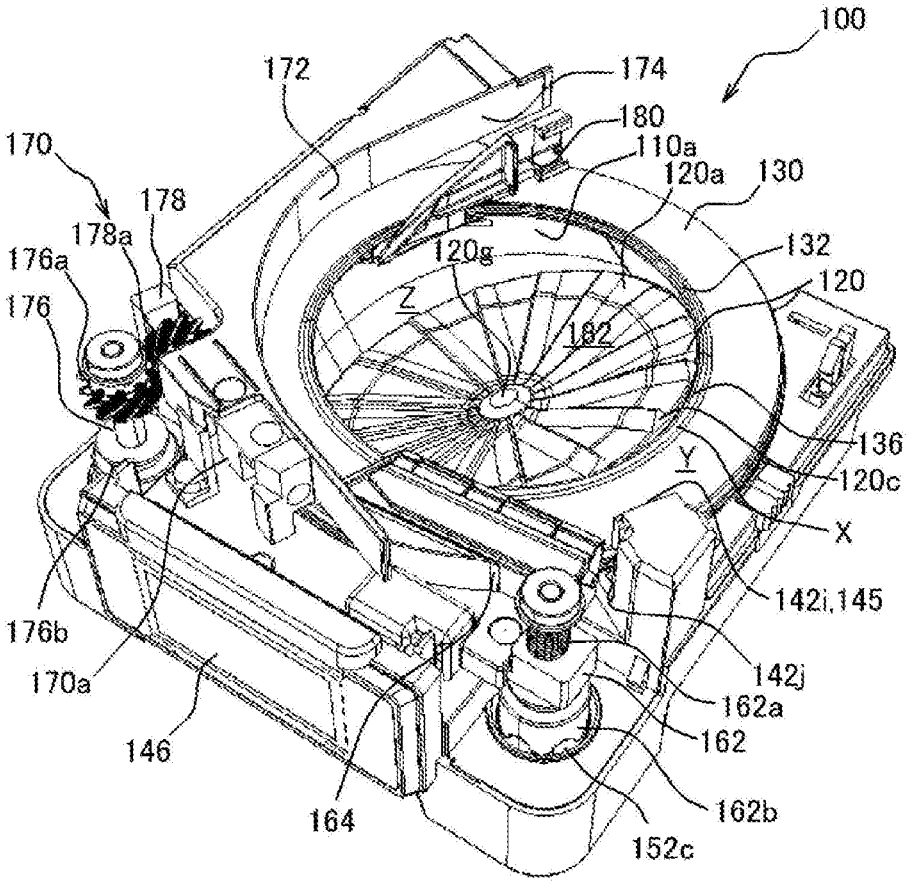
FIG. 12 is a perspective view showing a state that the cover body and a cassette body portion are removed from the medicine cassette shown in FIG. 3 and a width restricting body is moved to a width-narrowed position.
Figure 13:
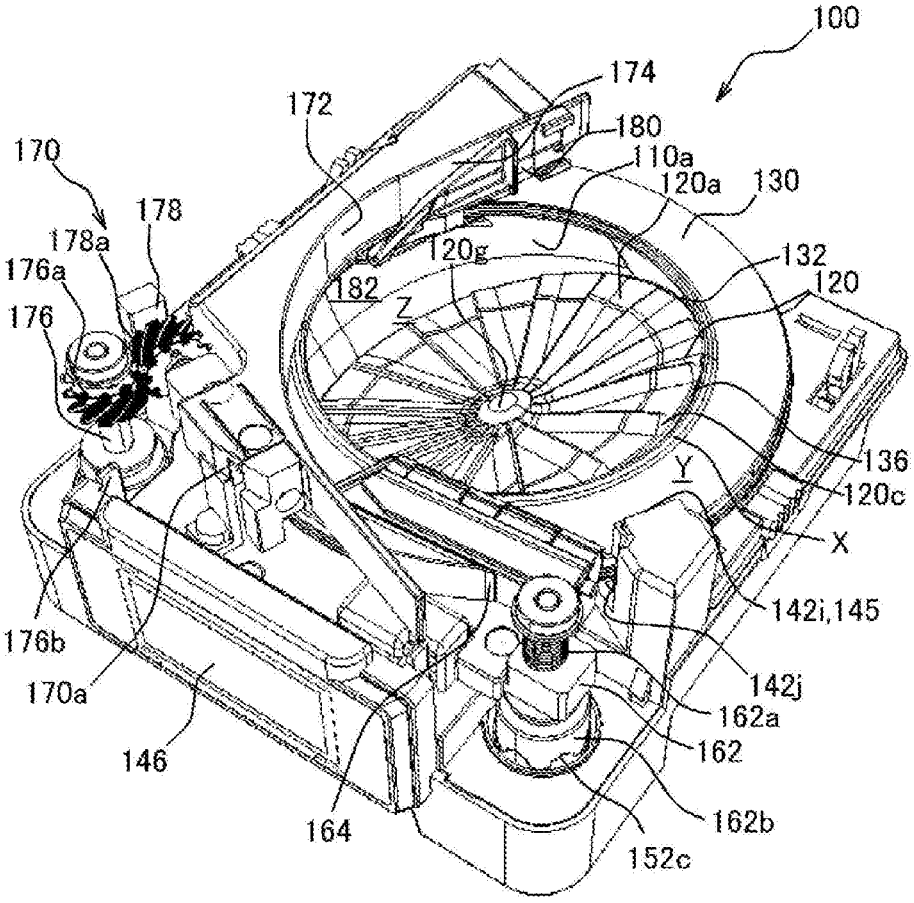
FIG. 13 is a perspective view showing a state that the cover body and the cassette body portion are removed from the medicine cassette shown in FIG. 3 and the width restricting body is moved to a width-expanded position.

As shown in FIG. 12 and FIG. 13, the width restricting body 170 has a first guide plane 172 gradually curved toward the outer diameter side along the outer periphery of the second rotating body 130 and a flat second guide plane 174 continued to the first guide plane 172. A first axis member 176 and a second axis member 178 are arranged on the outer diameter side of the first guide plane 172. A driving gear 176*a* is provided at an upper-end portion of the first axis member 176 and a second input gear 176*b* is provided at a lower-end portion of the first axis member 176. The driving gear 176*a* meshes with a driven gear 178*a* provided at one end portion of the second axis member 178. Further, the second input gear 176*b* meshes with the second output gear 154*c* through the above-mentioned opening 142*f*. Further, a male screw (not shown in the drawings) is formed on the other end portion (on the opposite side with respect to the driven gear 178*a*) of the second axis member 178. The other end portion of the second axis member 178 is screwed with a female screw of a female screw member 170*a* integrated with the width restricting body 170.

When the first axis member 176 normally or reversely rotates, the second axis member 178 rotates through the driving gear 176*a* and the driven gear 178. Along with this, the width restricting body 170 moves in the axial line direction of the second axis member 178. By switching a rotational direction of the first axis member 176, it is possible to reciprocate the width restricting member between a width-expanded position shown in FIG. 12 and a width-narrowed position shown in FIG. 13.

In this regard, in this embodiment, both of the height restricting body 160 and the width restricting body 170 are provided on the side of the cassette body portion 144 and both of the height restricting body driving force transmission portion 152 and the width restricting body driving force transmission portion 154 are provided on the side of the cassette bottom portion 142. Further, the coupling and the transmission of the driving force between the height restricting body 160 and the height restricting body driving force transmission portion 152 are achieved by meshing the first output gear 152*c* with the first input gear 162*b*. The coupling and the transmission of the driving force between the width restricting body 170 and the width restricting body driving force transmission portion 154 are achieved by meshing the second output gear 154*c* with the second input gear 176*b*. Further, these first output gear 152*c* and second output gear 154*c* are arranged outside the cassette bottom portion 142 with being exposed from the openings 142*g*, 142*f* respectively.

As described above, the first output gear 152*c* and the second output gear 154*c* are arranged outside the cassette bottom portion 142. Thus, the first input gear 162*b* and the second input gear 176*b* respectively meshed with these output gears can be removed from the cassette bottom portion 142 by lifting up the cassette body portion 144 in a state that the first input gear 162*b* and the second input gear 176*b* are attached to the cassette body portion 144. Namely, the medicine cassette 100 is configured to enable the cassette bottom portion 142 and the cassette body portion 144 to be separated from each other even in a state that the height restricting body 160 and the width restricting body 170 are not separated from the cassette body portion 144 and the bevel gears 152*f*, 152*g* are respectively meshed with the bevel gears 154*f*, 154*g*. With this configuration, it is possible to separate the cassette body portion 144 and the cassette bottom portion 142 from each other and remove the side-wall constituent body 110 and the first rotating body 120 to clean up the inside and the bottom portion of the cassette bottom portion 142.

Further, in this embodiment, as shown in FIG. 7 and the like, the bevel gears 152*g*, 154*g* respectively coupled with the first driving force transmission axis 152*b* and the second driving force transmission axis 154*b* are configured to be located on the lower side of the bevel gears 152*f*, 154*f* respectively coupled with the first output axis 152*e* and the second output axis 154*e*. Here, it may be possible to take another configuration example in which the bevel gears 152*g*, 154*g* are located on the upper side of the bevel gears 152*f*, 154*f* so that the bevel gears can be separated from each other, the first output gear 152*c* and the first input gear 162*b* cannot be separated from each other and the second output gear 154*c* and the second input gear 164*c* cannot be separated from each other. Even in the case of employing such a configuration, the cassette bottom portion 142 and the cassette body portion 144 can be detached from each other by moving the cassette body portion 144 toward the upper side from the cassette bottom portion 142. However, in the case of employing such a configuration, there is a possibility that ridges of teeth of the bevel gears 152*f*, 152*g* and the bevel gears 154*f*, 154*g* make contact with each other and the engagements among them become difficult at the time of again attaching the cassette body portion 144 to the cassette bottom portion 142.

As shown in FIG. 6 and FIG. 7, an inner-wall 144*a* having a rectangular frame shape and constituting a part (about half) of an inner peripheral surface along the outer peripheral edge of the second rotating body 130 is formed on the inner periphery side of the cassette body portion 144. A discharging guide piece 180 (see FIG. 12) is attached to one end portion of the inner-wall 144*a* and this guides the medicines transferred by the second rotating body 130 to the hopper 82*a* through the medicine discharging part 144*c*.

As shown in FIG. 6, a guide portion 144*b* is provided in the cassette body portion 144. The guide portion 144*b* is used for guiding the medicines when the medicines prepared in the medicine containing part 182 are collected. The guide portion 144*b* is provided at a position adjacent to the riding-over area Y described later in detail on the outer side of the radial direction of the first rotating body 120 and the second rotating body 130. Further, in the medicine cassette 100, although the support axis for connecting the cover body 102 to the cassette body portion 144 so that the cover body 102 can be pivotally moved with respect to the cassette body portion 144 is provided on one end side of the width direction of the cassette body portion 144, the guide portion 144*b* is provided on the opposite side with respect to the side on which this support axis is provided (the other end side of the cassette body portion 144). Further, at a position where the guide portion 144*b* is provided, the cassette body portion 144 is formed into a concave shape and concaved into a spout-like shape. Thus, when the medicines prepared in the medicine containing portion 182 are collected, by opening the cover body 102 and inclining the medicine cassette 100 so that the side on which the guide portion 144*b* is provided is located on the lower side, the medicines are automatically aggregated in the guide portion 144*b* and discharged (collected).

Further, as shown in FIG. 6 and FIG. 7, the medicine discharging portion 144*c* for discharging the medicines is provided on the rear side of the cassette body portion 144. By attaching the medicine cassette 100 to the base portion 60, the medicines can be discharged from the opening constituting the medicine discharging part 144*c* toward the hopper 82*a*.

The side-wall constituent body 110 has the upper-end opening portion along the inner peripheral edge of the second rotating body 130 and extends toward the lower side. The lower-end opening portion of the side-wall constituent body 110 is diagonally cut in accordance with an inclination angle of the first rotating body 120. The medicine containing part 182 (see FIG. 9 to FIG. 15B) which can contain the medicines is formed in an area defined by the inner peripheral surface of the side-wall constituent body 110 and the upper surface of the first rotating body 120.

Figure 14:
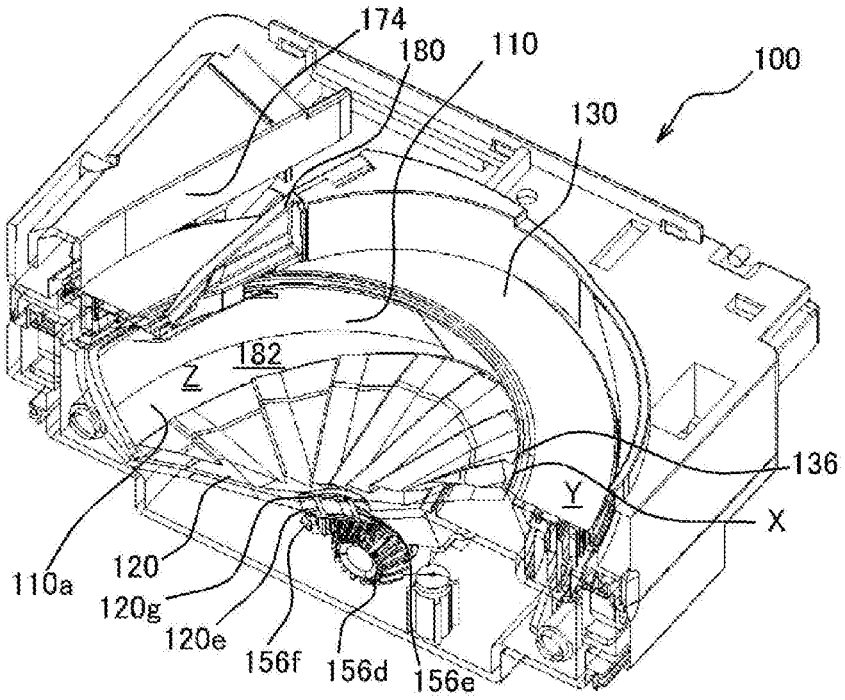
FIG. 14 is a perspective view showing a state that a cross-section of the medicine cassette shown in FIG. 6 is viewed.
Figure 15A:
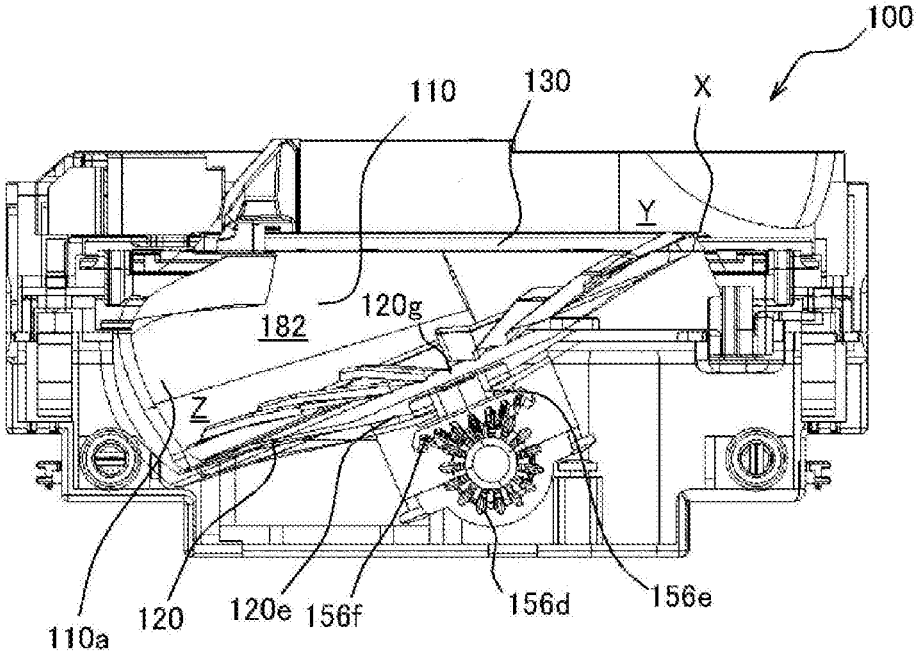
FIG. 15A is a cross-sectional view of the medicine cassette shown in FIG. 6
Figure 15B:
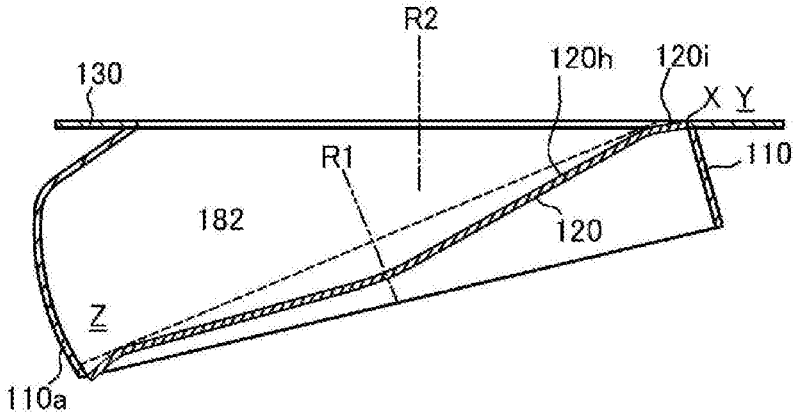
FIG. 15B is a cross-sectional view for explaining a relationship among the first rotating body, the second rotating body and the side-wall constituent body.

As shown in FIG. 10 and FIG. 12 to FIG. 15B, the side-wall constituent body 110 has an expanding portion 110*a* expanding toward the outer side of the radial direction of the second rotating body 130 on the lower side of the second rotating body 130. When a position where the outer peripheral edge of the first rotating body 120 and the inner peripheral edge of the second rotating body are adjacent to each other on the upper side of the side-wall constituent body 110 is defined as a reference position (hereinafter, this position is sometimes referred to as "medicine riding-over position X"), the expanding portion 110*a* is provided on an area (hereinafter, this area is sometimes referred to as "scraping-up side area Z") on the opposite side of the radial direction of the first rotating body 120 with respect to an area (hereinafter, this area is sometimes referred to as "riding-over side area Y") on the side on which the medicine riding-over position X exists. In this embodiment, as shown in FIGS. 15(*a*), 15(*b*), the expanding portion 110*a* is provided so as to slightly expand toward the outer side of the radial direction than the outer peripheral edge of the second rotating body 130 on the lower side of the second rotating body 130. If this expanding amount of the expanding portion 110*a* increases, a size of the medicine cassette 100 becomes large. Thus, it is possible to take a configuration in which the expanding portion 110*a* does not expand toward the outer side of the radial direction than the outer peripheral edge of the second rotating body 130.

As shown in FIG. 10, FIG. 12 to FIG. 14 and the like, the first rotating body 120 is formed into a circular plate-like shape and has an upper-side portion 120*a* and a lower-side portion 120*b*. As shown in FIG. 12 to FIG. 15B and the like, the first rotating body 120 is arranged in the lower-end opening portion of the side-wall constituent body 110 and inclined with respect to the horizontal plane.

As shown in FIG. 16 and the like, a plurality of projections 120*c* extending from the center side toward the outer diameter side are formed on an upper surface of the upper-side portion 120*a*. Each projection 120*c* is inclined toward a direction opposite to the rotational direction of the first rotating body 120 with respect to a line extending from the rotational center of the first rotating body 120 in the radial direction. Further, each projection 120*c* has a first inclined surface 120*x* protruding from the upper surface of the upper-side portion 120*a* and a second inclined surface 120*y* inclined so as to gradually approach to the upper surface of the upper-side portion 120*a* as it goes in the rotational direction. An inclination angle of the first inclined surface 120*x* with respect to the upper surface of the upper-side portion 120*a* is set to be larger than the second inclined surface 120*y*. The first inclined surface 120*x* may be constituted of a plane perpendicular to the upper surface of the upper-side portion 120*a*. With this configuration, when the first rotating body 120 rotates, the medicines are pushed by the second inclined surface 120*y* and moved in the rotational direction. Since the medicines are pushed by the second inclined surface 120*y*, component force in the rotational direction is not so large and the medicines are smoothly transferred in the rotational direction by an appropriate amount. Further, since the projections 120*c* diagonally extend toward the opposite side with respect to the rotational direction, the medicines are also moved to the outer diameter side and transferred onto the upper surface of the second rotating body 130.

Figure 17A:
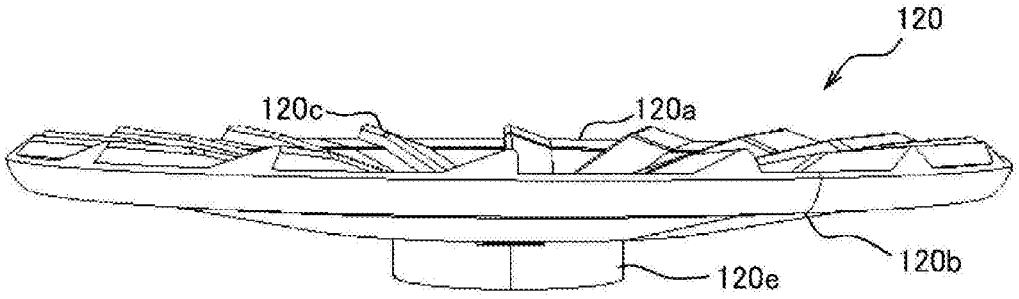
FIG. 17A is a side view of the first rotating body and FIG. 17B is a perspective view of the first rotating body viewed from the side of a lower-side portion.
Figure 17B:
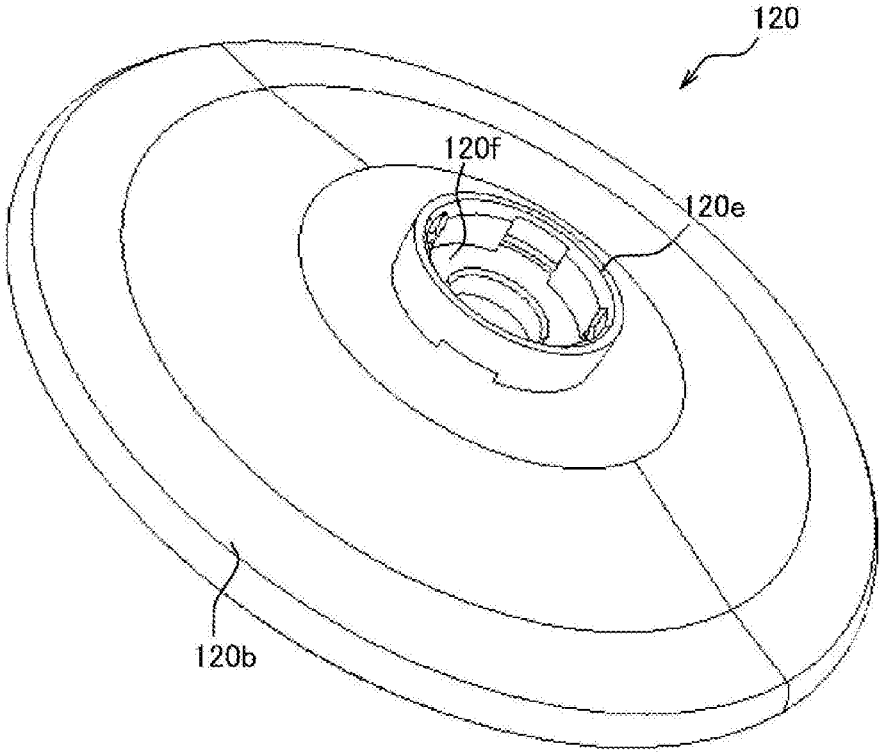

As shown in FIG. 17A and FIG. 17B and the like, the connecting portion 120*e* (the connecting portion) is provided at the center of the lower-side portion 120*b*. The connecting portion 120*e* is formed into a cylindrical shape protruding from the lower-side portion 120*b*. As shown in FIG. 14 and FIG. 15A, the connecting portion 120*e* is a portion into which the connecting portion 156*g* of the driving force transmission portion 156*g* is inserted. The connecting member 120*f* formed with a circular plate-like metallic plate made of a magnetic body such as iron or a magnet is attached to the inside of the connecting portion 120*e*. Thus, by setting the first rotating body 120 so that the connecting portion 156 on the side of the driving force transmission portion 156 is inserted into the connecting portion 120*e*, it is possible to connect the first rotating body 120 with the driving force transmission portion 156 with magnetic force so that the first rotating body 120 and the driving force transmission portion 156 can integrally rotate.

As described above, the first rotating body 120 is connected to the connecting portion 156*g* of the driving force transmission portion 156. Here, as shown in FIG. 15B and the like, the connecting axis 156*b* at which the connecting portion 156*g* is provided is inclined with respect to the side-wall constituent body 110 and a second rotational axis R2 which is the rotational axis (the axial line) of the side-wall constituent body 110 and the second rotating body 130 by a predetermined angle. Thus, the first rotating body 120 is configured to be capable of rotating around a rotational axis (a first rotational axis R1) inclined with respect to the second rotational axis R2 of the side-wall constituent body 110 and the second rotating body. Further, the first rotating body 120 is arranged in a posture in which the first rotating body 120 is upwardly inclined from the bottom side toward the upper-end side of the side-wall constituent body 110 by a predetermined angle so as to form a raising slope. In a case where the first rotating body 120 is set with a posture in which the rotational axis is vertical, the first rotating body 120 is downwardly inclined from the outer side toward the inner side of the radial direction by a predetermined angle so as to form a falling slope in the outer peripheral portion. Thus, in a state that the first rotating body 120 is arranged in the medicine cassette 100, although the outer peripheral portion of the first rotating body 120 forms the raising slope in the outer peripheral portion as is the case with the inner peripheral portion, a gradient amount in the outer peripheral portion on the side of the riding-over side area Y is smaller than a gradient in the inner peripheral portion.

As shown in FIG. 15B, the first rotating body 120 has a cross-sectional shape curved or bent so that the cross-sectional shape has a concave portion on the upper-side portion 120*a* on the side of the medicine containing part 182 in an area (hereinafter, this area is sometimes referred to as "main area 120*h*") on the inner side of the radial direction than the outer peripheral portion 129*i*. Thus, compared with a case where the main area 120*h* has a plate-like shape (see the dotted line in FIG. 15B), the volume of the medicine containing part 182 is larger by an amount obtained by forming the main area 120*h* into the concave shape. Further, the first rotating body 120 is formed so as to have a cross-sectional shape downwardly inclined from the inner side toward the outer side of the radial direction in the outer peripheral portion 120*i*. Thus, in the first rotating body 120, a gradient at the position (the medicine riding-over position X) where the outer peripheral portion 120*i* is adjacent to the inner peripheral edge of the second rotating body 130 and the area (the riding-over side area Y) in the vicinity of the medicine riding-over position X on the upper-end side of the side-wall constituent body 110 becomes more gentle than a gradient in the main area.

Further, in the first rotating body 120, the upper-side portion 120*a* is formed continuously to an area adjacent to an area (a connecting portion corresponding area 120*g*) corresponding to the connecting portion 120*e*. In this embodiment, the connecting portion corresponding area 120*g* is formed into a shape smoothly continuing to the adjacent area. An expanding amount in the connecting portion corresponding area 120*g* is set to be substantially equal to the expanding amount of the projection 120*c* or less than the expanding amount of the projection 120*c*.

As shown in FIG. 6 and the like, the second rotating body 130 is an annular body arranged on the outer peripheral side of the upper-side opening portion of the side-wall constituent body 110 and having a predetermined width in the radial direction. An annular opening portion 132 protruding toward the upper side is formed on the inner peripheral edge of the second rotating body 130. The annular opening portion 132 is provided so that a lengthwise direction of the medicine positioned on the second rotating body 130 is directed toward the circumferential direction of the second rotating body 130 together with the first guide plane 172 and the second guide plane 174. Namely, the medicines positioned on the second rotating body 130 are transferred with being guided by the first guide plane 172 and the second guide plane 174 and transferred with a posture that the lengthwise direction of each medicine is directed toward the transferring direction. Here, a distance between the discharging guide piece 180 and the second guide plane 174 is set to be slightly larger than a dimension of the medicine in a direction perpendicular to the lengthwise direction of the medicine. By directing the lengthwise direction of the medicine toward the circumferential direction of the second rotating body 130, it is possible to discharge the medicines into the hopper 82*a*. A height of the annular opening portion 132 is set to be a level enough for smoothly performing the movement of the medicines from the first rotating body 120 and suppressing the medicines from dropping into the inside when the medicines are transferred by the rotation of the second rotating body 130. Further, a second rotating body driven gear 134 is formed on the lower surface of the second rotating body 130 in the circumferential direction. As shown in FIG. 8B, the second rotating body driven gear 134 is partially exposed on the rear side of the cassette main body 140. The second rotating driven gear 134 meshes with the fourth driving gear 70*a* provided on the side of the base portion 60 when the medicine cassette 100 is attached to the base portion 60. Thus, by driving the fourth motor 70 provided on the side of the base portion 60, it is possible to transmit the driving force through the fourth driving gear 70*a* and the second rotating body driven gear 134 to rotate the second rotating body 130.

As shown in FIG. 12 to FIG. 14, a step portion 136 is formed on the outer peripheral edge of the second rotating body 130. A rotating guide portion 142*j* provided on a bottom portion cover body 142*b* of the cassette bottom portion 142 prevents the step portion 136 from floating up in a state that the second rotating body 130 is assembled with the cassette main body 140. The step portion 136 is positioned on the outer diameter side with respect to the position where the inner-wall 144*a* is provided in the cassette body portion 144. Thus, in the state that the second rotating body 130 is assembled with the cassette main body 140, the medicines transferred on the upper surface of the second rotating body 130 do not enter into a space between the step portion 136 and the rotating guide portion 142*j* and the upper surface of the second rotating body 130 is not scratched. Further, the rotating guide portion 142*j* is arranged on the upper side of the fourth driving gear 70*a*. With this configuration, it is possible to reliably suppress the floating-up at a portion where force is most strongly applied. Further, after disassembling and cleaning up the medicine cassette 100, it is possible to prevent backlash, positional shift and the like of the parts at the time of the assembling.

The cover body 102 is attached so that the cover body 102 can pivotally move around the support axis provided on one side portion of the cassette body portion 144. As shown in FIG. 2 and FIG. 8A, a cover-side insertion area 102*a* is formed at a position of the cover body 102 on the front side of the medicine cassette 100. The cover-side insertion area 102*a* is a concave portion opening toward the top side and the front side of the medicine cassette 100. The fingers can be inserted into the base-side insertion area 102*a* in the sliding direction (in this embodiment, the direction from the front side toward the rear side) at the time of attaching the medicine cassette 100 with respect to the base portion 60.

The medicine cassette 100 is configured to be appropriately disassembled and cleaned up. Namely, the medicine cassette 100 is configured so that the cassette body portion 144 can be removed from the cassette bottom portion 142 in a state that the height restricting body 160 and the width restricting body 170 are fixed and further the first rotating body 120 and the second rotating body 130 can be removed. As described above, since the medicine cassette 100 is configured so that the parts contacting with the medicines can be disassembled and cleaned up, it is possible to reliably prevent contamination (mixing of different medicines) even in a case where the kind of the medicines is changed or in a case where a part of the medicine is lacked and drops or powder is generated.

The control device 200 drives and controls each motor, the packaging part 40 and the like based on prescription data received from a server (not shown in the drawings) or a detection signal from the discharged medicine detecting device 82*b*.

Next, description will be given to operations of the medicine packaging apparatus 10 having the above-mentioned configuration. Since the medicine packaging apparatus 10 of this embodiment has features in a dispensing process for the medicines performed by the medicine cassette 100 in the medicine dispensing apparatus 55, the description will be given to only this operation and description for other operations is omitted.

<<Regarding the Dispensing Process for the Medicines>>

Figure 18:
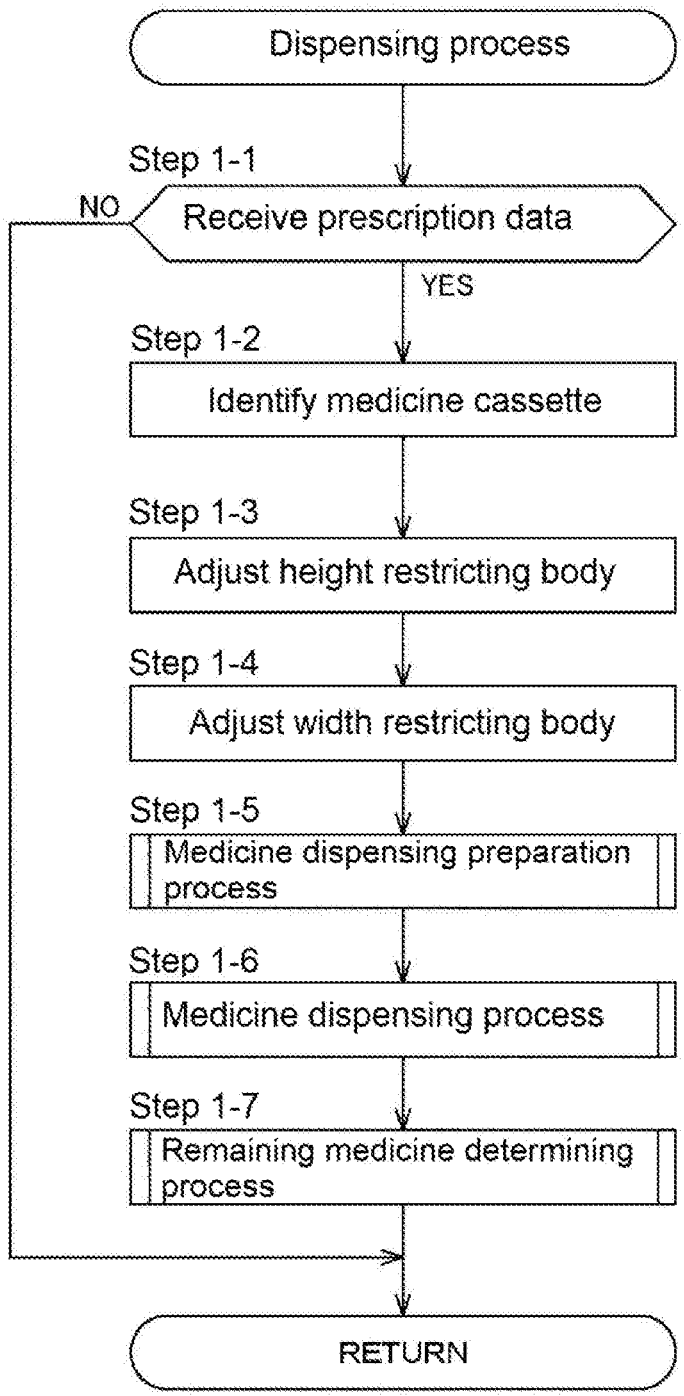
FIG. 18 is a flow chart showing a dispensing process performed in the medicine packaging apparatus shown in FIG. 1.

In a case of counting medicines whose use frequency is low or the number of the medicines, the medicines can be contained in the medicine cassette 100 provided in the medicine dispensing apparatus 55 and dispensed according to a control flow shown in FIG. 18 to package the medicines. Hereinafter, a medicine dispensing process will be described based on the control flow shown in FIG. 18.

(Step 1-1)

The control device 200 determines whether or not the prescription data to be prescribed by utilizing the medicine dispensing apparatus 55 is received from a host control device for the medicine packaging apparatus 10 or the like. Here, in a case of determining that the prescription data should be prescribed by utilizing the medicine dispensing apparatus 55 (step 1-1=YES), the process is shifted to a step 1-2. Otherwise (step 1-1=NO), the series of control flows are completed.

(Step 1-2)

At the step 1-2, a process for identifying which medicine cassette 100 should be utilized for dispensing the medicines among the plurality of medicine cassettes 100 provided in the medicine dispensing apparatus 55. For example, the control device 200 can perform the process of the step 1-2 with a method of preparing a data table in which information on the medicines prepared in the medicine cassettes 100 is registered in advance and referring to this data table at the step 1-2 to identify which medicine cassette 100 prepares the medicines to be prescribed or the like. In addition, various methods such as a method of identifying the medicine cassette 100 designated by the user as the one to be utilized for dispensing the medicines can be considered as the method for the process at the step 1-2. When the identifying of the medicine cassette 100 to be utilized for dispensing the medicines is completed at the step 1-2, the process is shifted to a step 1-3.

(Step 1-3)

At the step 1-3, the control device 200 performs a process for moving up and down the height restricting body 160 of the medicine cassette 100 identified at the step 1-2 according to the information (a shape, a size and the like) on the medicines to be dispensed. Specifically, by operating the first motor 64, the height restricting body 160 is moved up and down to set the clearance between the lower surface of the height restricting body 160 and the upper surface of the second rotating body 130 to a clearance (height) through which only one medicine can pass. With this configuration, the medicine cassette 100 can dispense the medicines in response to a variety of shapes and sizes of the medicines. Further, unlike the case of distributing the medicines into the manually distributed medicine supplying part 30, it is unnecessary to distribute the medicines for every one package. When the adjustment of the height restricting body 160 is completed, the process is shifted to a step 1-4. In this regard, the information on the shape and the size of the medicines can be obtained by various methods such as a method of referring to a database related to information on predetermined medicines, for example.

(Step 1-4)

At the step 1-4, the control device 200 performs a process for moving up and down the width restricting body 170 of the medicine cassette 100 identified at the step 1-2 according to the information (the shape, the size and the like) on the medicines to be dispensed. Specifically, by operating the second motor 66 to horizontally move the width restricting body 170 for adjusting the positions of the first guide plane 172 and the second guide plane 174 of the width restricting body 170. With this operation, the clearance between the inner peripheral edge of the second rotating body 130 and the first guide plane 172 in the radial direction is set to a dimension through which only one medicine can move. With respect to a width w of the medicine (a dimension in a direction crossing the lengthwise direction), it is preferable to control so that this dimension W1 becomes equal to or larger than ½w and equal to or less than w ($\frac{1}{2}w \leq W1 \leq w$). Further, it is preferable to control so that a dimension W2 between the second guide plane 172 and the discharging guide piece 180 becomes equal to or larger than the width w of the medicine and equal to or less than 1.5 times of the width w of the medicine (1.5w) ($w \leq W2 \leq 1.5w$). When the adjustment of the width restricting body 170 is completed, the process is shifted to a step 1-5.

(Step 1-5)

At the step 1-5, the control device 200 performs operation control for the medicine cassette 100 for performing a medicine dispensing preparation operation. As described later in detail, the medicine dispensing preparation operation is performed by rotating the first rotating body 120 and the second rotating body 130 with a high speed according to a control flow shown in FIG. 19. Rotational speeds of the first rotating body 120 and the second rotating body 130 at the time of the medicine dispensing preparation operation are set to be higher than the rotational speeds at the time of the medicine dispensing operation (the step 1-6). By performing the medicine dispensing preparation operation, the medicines prepared in the medicine containing part 182 are quickly transferred and placed onto the second rotating body 130 and reached to the position on the downstream side of the transferring direction of the medicines than the medicine riding-over position X, thereby reducing a time required for dispensing a head (first) medicine. When the medicine dispensing preparation operation is completed, the process is shifted to a step 1-6.

(Step 1-6)

At the step 1-6, the control device 200 performs operation control for the medicine cassette 100 for performing the medicine dispensing process. As described later in detail, the medicine dispensing process is performed by rotating the first rotating body 120 and the second rotating body 130 according to a control flow shown in FIG. 20. The rotational speed of the second rotating body 130 at the time of the medicine dispensing operation is set to be slower than the rotational speed at the time of the above-mentioned medicine dispensing preparation operation. In this regard, the rotational speed of the first rotating body 120 at the time of the medicine dispensing operation may be equal to the rotational speed at the time of the medicine dispensing preparation operation. Further, while the medicine dispensing process is performed for one of the plurality of provided medicine cassettes 100, it may be possible to perform the medicine dispensing preparation operation (the step 1-5) for another medicine cassette 100 for which the medicine dispensing process will be performed in next time. With this configuration, it is possible to quickly discharge the medicines from the medicine cassette 100 for which the medicine dispensing process will be performed in next time after the medicine dispensing process for the medicine cassette 100 from which the dispensing of the medicines should be performed in first is completed. When the medicine dispensing operation is completed, the process is shifted to a step 1-7.

(Step 1-7)

At the step 1-7, the control device 200 performs operation control for the medicine cassette 100 for performing a remaining medicine determining process. The remaining medicine determining process is a process for determining a possibility that the medicines remain in the medicine cassette 100 after the dispensing of the medicines at the step 1-6 is completed. As described later in detail, the remaining medicine determining process is performed according to a control flow shown in FIG. 21. When the remaining medicine determining process is completed, the series of control flows are completed. In this regard, in a case where an error notice (step 1-6-11) along with the dispensing error of the medicines is performed in the medicine dispensing process described later in detail, the remaining medicine determining process according to the step 1-7 may be omitted.

<<Regarding the Medicine Dispensing Preparation Process>>

Figure 19:
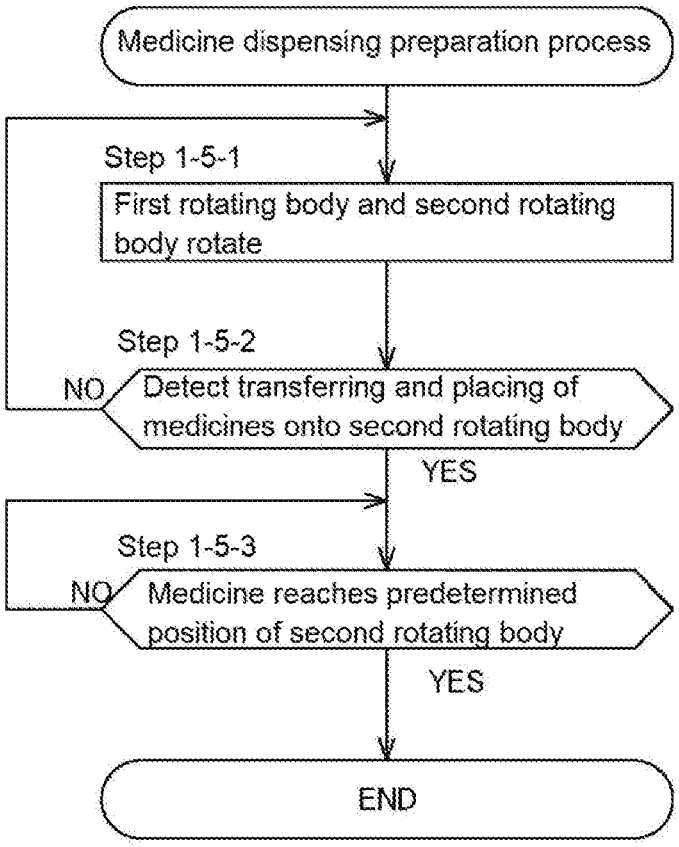
FIG. 19 is a flow chart showing a medicine dispensing preparation process performed in the flow shown in FIG. 18.

Subsequently, the medicine dispensing preparation process performed at the above-mentioned step 1-5 will be described according to the control flow shown in FIG. 19.

(Step 1-5-1)

At a step 1-5-1, the control device 200 rotates the first rotating body 120 and the second rotating body 130 in a normal direction. Here, the rotational speeds of the first rotating body 120 and the second rotating body 130 are respectively set to be higher than the rotational speeds of the first rotating body 120 and the second rotating body 130 in the medicine dispensing process performed later. After that, the process is shifted to a step 1-5-2.

(Step 1-5-2)

At the step 1-5-2, the control device 200 determines whether or not the medicines are transferred and placed onto the second rotating body 130. In this embodiment, it is determined that the medicines are transferred and placed onto the second rotating body 130 on a condition that the medicines are detected by the transferred medicine detecting body 145. In a case of determining that the medicines are transferred and placed onto the second rotating body 130 (step 1-5-2=YES), the process is shifted to a step 1-5-3. In a case of not determining that the medicines are transferred and placed onto the second rotating body 130, the process is returned to the step 1-5-1.

(Step 1-5-3)

At the step 1-5-3, the control device 200 determines whether or not a timing (hereinafter, this timing is sometimes referred to as "preparation complete timing") at which it is expected that the medicine on the head side of the transferring direction of the medicines among the medicines transferred and placed on the second rotating body 130 reaches a predetermined position has come. Specifically, the timing at which it is expected that the medicine reaches a position advanced from the medicine riding-over position X by a predetermined amount (in this embodiment, this amount is 180 degrees) in the circumferential direction is defined as the preparation complete timing and it is determined whether or not this timing has come. Although the determination whether or not the preparation complete timing has come can be performed with various methods, this determination in this embodiment is performed by determining whether or not a timing passing a predetermined time after a timing at which the medicines are detected at the step 1-5-2 has come. In a case of not determining that the preparation complete timing has come (step 1-5-3=NO), the process is returned to the step 1-5-1. In a case of determining that the preparation complete timing has come (step 1-5-3=YES), the series of control flows are completed.

<<Regarding the Medicine Dispensing Process>>

Figure 20:
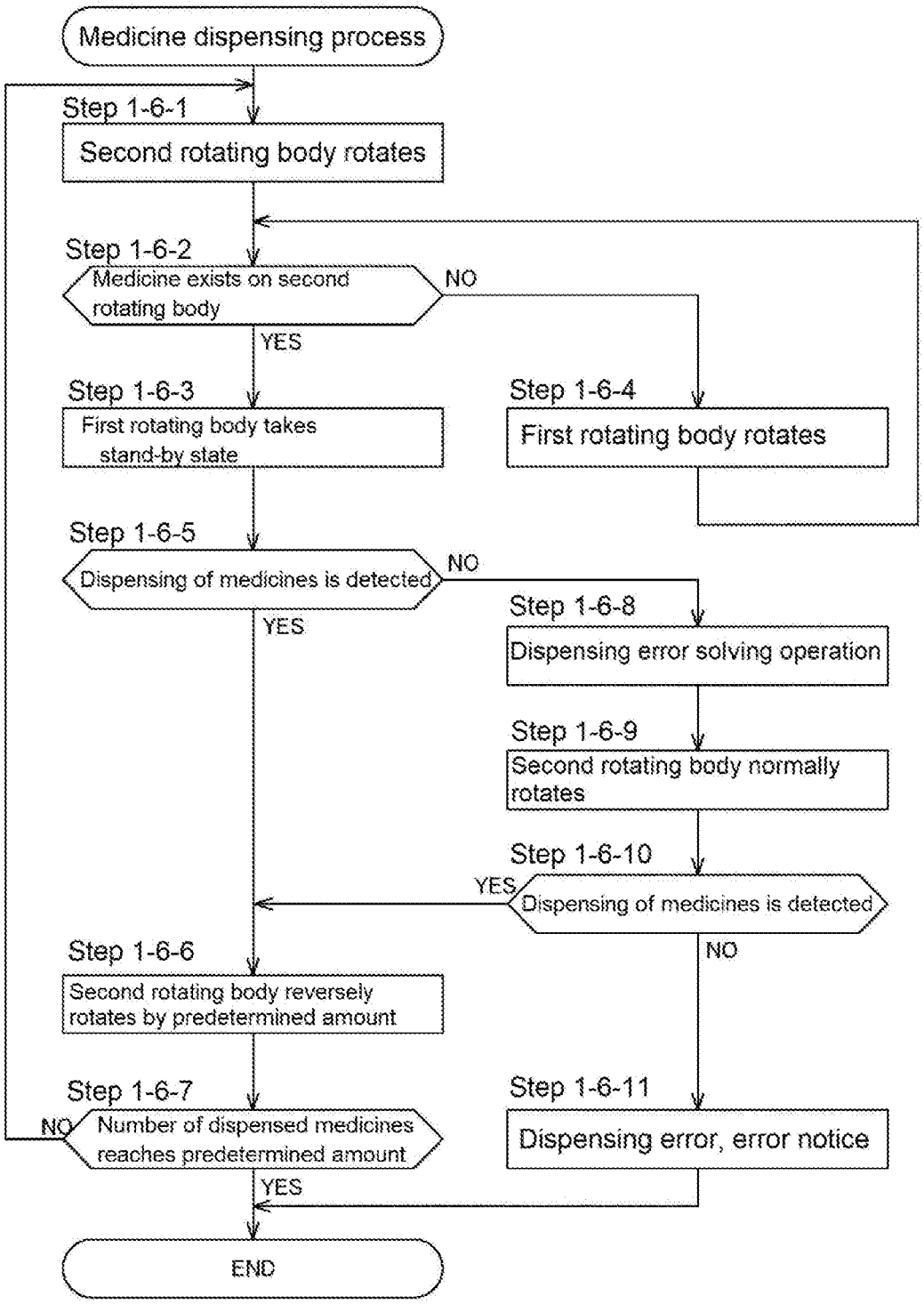
FIG. 20 is a flow chart showing a remaining medicine dispensing process performed in the flow shown in FIG. 18.

Subsequently, the medicine dispensing process performed at the above-mentioned step 1-6 will be described according to the control flow shown in FIG. 20.

(Step 1-6-1)

At a step 1-6-1, the control device 200 rotates the second rotating body 130. The rotational speed of the second rotating body 130 is set to be slower than the rotational speed of the second rotating body 130 in the medicine dispensing preparation process. In this regard, at the step 1-6-1, the first rotating body 120 may be rotated or brought into a state that the first rotating body 120 is stopped without being rotated. After the start of the rotation of the second rotating body 130, the process is shifted to a step 1-6-2.

(Step 1-6-2)

At the step 1-6-2, the control device 200 determines whether or not the medicines exist on the second rotating body 130. Specifically, it is determined whether or not the medicines are detected by the transferred medicine detecting body 145 arranged on the lateral side of the second rotating body 130. Here, in a case of determining that the medicines exist on the second rotating body 130 (step 1-6-2=YES), the process is shifted to a step 1-6-3. On the other hand, in a case of not determining that the medicines exist on the second rotating body 130 (step 1-6-2=NO), the process is shifted to a step 1-6-4.

(Step 1-6-3)

At the step 1-6-3, the control device 200 performs operation control for bringing the first rotating body 120 into a stand-by state. Namely, in a state that the process is shifted to the step 1-6-3, the medicines exist on the second rotating body 130 and thus it is not necessary to transfer and place the medicines from the first rotating body 120 onto the second rotating body 130 more than necessary. Thus, at the step 1-6-3, the control device 200 performs the control for bringing the first rotating body 120 into the stand-by state.

Although the first rotating body 120 may be completely stopped in the stand-by state, the first rotating body 120 may be rotated with a slower speed than the step 1-6-1 or irregularly rotated. In the case of irregularly rotating the first rotating body 120, the rotation and the stop are repeated in sequence or the rotational speed may be continuously or intermittently changed. When the first rotating body 120 is brought into the stand-by state at the step 1-6-3, the process is shifted to a step 1-6-5.

(Step 1-6-4)

At the step 1-6-4, the control device 200 performs control for keeping the rotation of the first rotating body 120. Namely, when the process is shifted to the step 1-6-4, there is a concern that the medicines are not detected by the transferred medicine detecting body 145 at the step 1-6-2 and the medicines are not sufficiently prepared on the second rotating body 130. Thus, at the step 1-6-4, the rotation of the first rotating body 120 is started. After that, the process is returned to the step 1-6-2.

(Step 1-6-5)

At the step 1-6-5, the control device 200 determines whether or not the medicines are dispensed from the medicine cassette 100 based on an output signal from the discharged medicine detecting device 82*b*. As a result, in a case of detecting that the medicines are discharged within a predetermined time period from the start of the rotation of the second rotating body 130 (step 1-6-5=YES), the process is shifted to a step 1-6-6. On the other hand, in a case of not detecting that the medicines are discharged even after the predetermined time period from the start of the rotation of the second rotating body 130 has passed (step 1-6-5=NO), there is a possibility that the dispensing error occurs because of clogging of the medicines or the like. Thus, in this case, the process is shifted to a step 1-6-8.

(Step 1-6-6)

At the step 1-6-6, the control device 200 performs a process for reversely rotating the second rotating body 130 by a predetermined amount. Although a rotational speed of the second rotating body 130 at the time of the reverse rotation may be equal to that at the time of the normal rotation, the rotational speed of the second rotating body 130 at the time of the reverse rotation is set to be higher than that at the time of the normal rotation. Specifically, at the time of the reverse rotation, the second rotating body 130 is rotated with a rotational speed of about 1.5 to 2 times of the rotational speed at the time of the normal rotation. With this configuration, it is possible to prevent the medicines from being mistakenly dispensed subsequent to the medicines whose dispensing is detected at the step 1-6-5 or a step 1-6-10 and expand the distances between the medicines aligned on the second rotating body 130. When the process at the step 1-6-6 is completed, the process is shifted to a step 1-6-7.

(Step 1-6-7)

At the step 1-6-7, the control device 200 determines whether or not the number of the medicines discharged from the medicine cassette 100 reaches a predetermined number. In this regard, in the medicine dispensing process, in a case where the transferred medicine detecting body 145 does not detect the medicines any more, the medicines may be moved onto the second rotating body 130 by rotating the first rotating body 120 with a high speed. Here, in a case of determining that the dispensing of the medicines by the predetermined number is completed (step 1-6-7=YES), the series of processes are completed. On the other hand, in a case where the number of the dispensed medicines does not reach the predetermined number, the process is returned to the step 1-6-1.

(Step 1-6-8)

In the case where the process is shifted from the step 1-6-5 to the step 1-6-8, there is the concern that the dispensing error such as clogging of the medicines occurs as described above. Thus, at the step 1-6-8, the control device 200 allows the medicine cassette 100 to perform an operation (a dispensing error solving operation) for solving the dispensing error. The dispensing error solving operation may be any operation as long as it can possibly solve a cause of the dispensing error. In this embodiment, control for reversely rotating the second rotating body 130, that is control for rotating the second rotating body 130 by a predetermined amount or for a predetermined time period in a direction in which the medicines are moved toward the opposite side with respect to the discharging port is performed. With this configuration, the posture of the medicines accumulated in the vicinity of the discharging port of the medicine cassette 100 is collapsed and thereby the solving of the dispensing error is expected. When the dispensing error solving operation is performed as described above, the process is shifted to a step 1-6-9.

(Step 1-6-9)

At the step 1-6-9, the control device 200 performs control for rotating the second rotating body 130 in the normal direction. With this control, the dispensing operation for the medicines temporally stopped for the dispensing error solving operation at the step 1-6-8 is restarted. After that, the process is shifted to the step 1-6-10.

(Step 1-6-10)

At the step 1-6-10, the control device 200 determines whether or not the medicines are dispensed from the medicine cassette 100 based on the output signal from the discharged medicine detecting device 82*b*. As a result, in a case of detecting the discharging of the medicines (step 1-6-10=YES), the process is shifted to the above-mentioned step 1-6-6. In a case of not detecting the discharging of the medicines (step 1-6-10=NO), the process is shifted to a step 1-6-11.

(Step 1-6-11)

In the case where the process is shifted to the step 1-6-11, this case means that the dispensing error of the medicines is not solved even after performing the dispensing error solving operation at the step 1-6-8. Thus, in this case, the control device 200 performs the error notice to inform the user that maintenance is required. After that, the series of processes are completed.

<<Regarding the Remaining Medicine Determining Process>>

Figure 21:
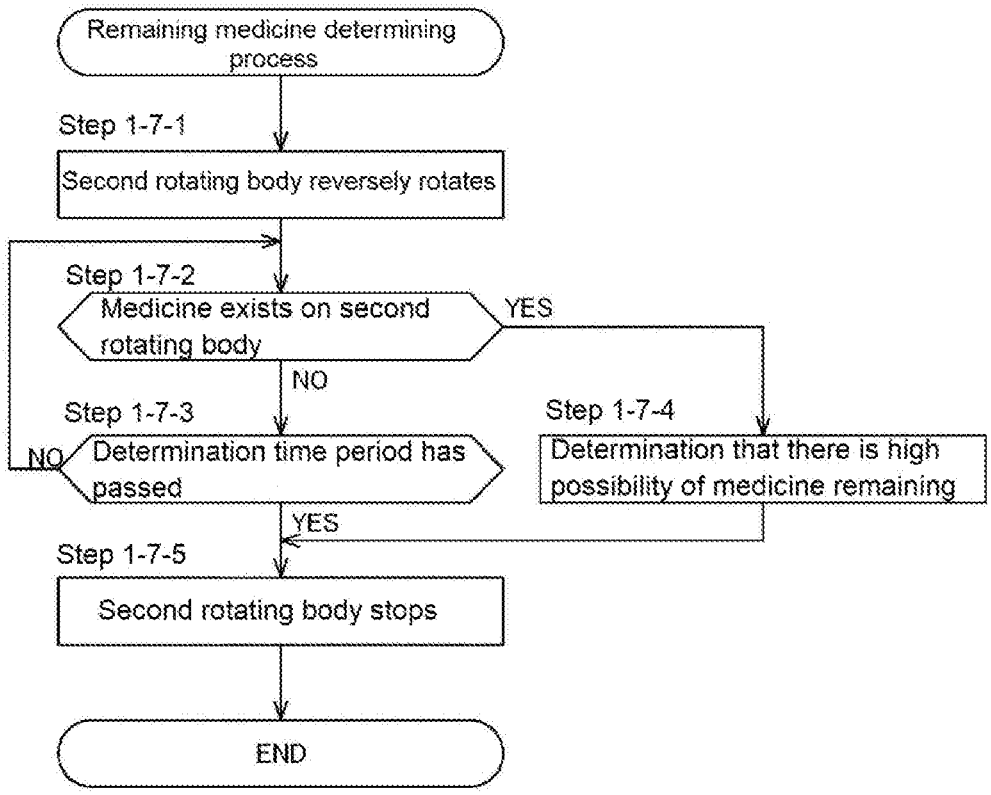
FIG. 21 is a flow chart showing a remaining medicine determining process performed in the flow shown in FIG. 18.

Subsequently, the remaining medicine determining process performed at the above-mentioned step 1-7 will be described according to the control flow shown in FIG. 21.

(Step 1-7-1)

At the step 1-7-1, the control device 200 performs a process for starting the reverse rotation of the second rotating body 130. In a case where the medicines exist on the second rotating body 130, the medicines are returned to the upstream side of the dispensing direction. After that, the process is shifted to a step 1-7-2.

(Step 1-7-2)

At the step 1-7-2, the control device 200 determines whether or not the existence of the medicines on the second rotating body 130 is detected. In this embodiment, it is determined whether or not the medicines are detected by the transferred medicine detecting body 145 arranged on the lateral side of the second rotating body 130. Here, in a case of not detecting the medicines (step 1-7-2=NO), the process is shifted to a step 1-7-3. On the other hand, in a case of detecting the medicines (step 1-7-2=YES) the process is shifted to a step 1-7-4.

(Step 1-7-3)

At the step 1-7-3, the control device 200 determines whether or not a time corresponding to a predetermined determination time period has passed from the start of the reverse rotation of the second rotating body 103 at the step 1-7-1. Here, although the determination time period can be appropriately set, it is preferable that the determination time period is set to be equal to or longer than a time period expected to be required for allowing the medicine existing at a position on the most downstream side of the dispensing direction of the medicines (in the vicinity of the discharging port) on the second rotating body 130 to pass through the position where the sensor or the like (in this embodiment, this is the transferred medicine detecting body 145) for determining the presence/absence of the medicines is arranged. In a case of determining that the time corresponding to the determination time period has passes from the start of the reverse rotation of the second rotating body 130 at the step 1-7-3 (step 1-7-3=YES), the process is shifted to a step 1-7-5. On the other hand, in a case of determining that the time corresponding to the determination time period has not passes, the process is returned to the step 1-7-2.

(Step 1-7-4)

In the case where the process is shifted to the step 1-7-4, there is a significantly high possibility that the existence of the medicines is detected by reversely rotating the second rotating body 130 and the medicines remain in the medicine cassette 100. Thus, at the step 1-7-4, the control device 200 performs the determination that there is the high possibility that the medicines remain and performs an alert or the like indicating the high possibility. After that, the control flow is shifted to a step 1-7-5.

(Step 1-7-5)

In the case where the process is shifted to the step 1-7-5, the medicines are not detected even after the second rotating body 130 is reversely rotated for the predetermined determination time period. Thus, it can be considered that the possibility that the medicines remain in the medicine cassette 100 is low. Thus, at the step 1-7-5, the second rotating body 130 is stopped and the series of control flows are completed.

In the above-mentioned medicine cassette 100 of the present invention, the expanding portion 110*a* is provided on the side-wall constituent body 110. The expanding portion 110*a* expands toward the outer side of the radial direction on the lower side of the second rotating body 130 and thus it is possible to make the medicine containing part 182 larger by an amount corresponding to the expanding amount of the expanding portion 110*a*, thereby efficiently utilizing an area on the lower side of the second rotating body 130. Further, in this embodiment, the expanding portion 110*a* is provided in the scraping-up side area Z positioned on the opposite side of the radial direction of the first rotating body 120 with respect to the riding-over side area X in which the medicine riding-over position X (a rotating body adjacent portion) at which the first rotating body 120 and the second rotating body 130 are adjacent to each other exists. With this configuration, a volume occupied by the side-wall constituent body 110 in the area on the lower side of the riding-over area Y which does not contribute to the increase of the volume of the medicine containing part 182 is suppressed to a minimum. Thus, by providing the expanding portion 110*a* as described above, it is possible to further contribute to the improvements of the space efficiency in the medicine cassette 100 and the volume of the medicine containing part 182 with making the medicine cassette 100 compact.

In this regard, in this embodiment, although the example in which the expanding portion 110*a* is provided in the scraping-up side area Z and the expanding portion 110*a* is not provided on the lower side of the riding-over side area Y is described, the expanding portion 110*a* may be provided on the lower side of the riding-over area Y.

In the medicine cassette 100 of this embodiment, the transferred medicine detecting body 145 is provided and the medicines can be detected in the transfer path to the medicine discharging part 144*c* after the medicines are transferred and placed from the first rotating body 120 onto the second rotating body 130. Thus, according to the medicine cassette 100, it is possible to identify the transfer status of the medicines based on the detection signal from the transferred medicine detecting body 145 and utilize it for the operation control for the medicine cassette 100. Specifically, as described above, it is possible to utilize the detection information from the transferred medicine detecting body 145 for optimizing the rotational speed of the first rotating body 120 depending on whether or not the medicines exist on the second rotating body 130. Further, it is possible to utilize the detection information from the transferred medicine detecting body 145 for the application of determining the presence/absence of the discharging error in the medicine discharging part 144*c* and the application of determining the remaining status of the medicines after the completion of the dispensing of the medicines. In this regard, although the example in which the transferred medicine detecting body 145 is provided is described in this embodiment, the present invention is not limited thereto and it may be possible to take a configuration in which the transferred medicine detecting body 145 is not provided. Further, although the example in which the transferred medicine detecting body 145 is utilized for some applications such as the rotation control for the first rotating body 120, the detection of the discharging error of the medicines and the detection of the remaining status of the medicines, different detecting bodies such as sensors may be provided for each application.

In the medicine cassette 100 of this embodiment, the first rotating body 120 is formed into the concave shape on the side of the medicine containing part 182. With this configuration, compared with the case where the first rotating body 120 is formed into the shape such as a plate-like shape, it is possible to improve the volume of the medicine containing part 182 and make the medicine cassette 100 compact. Further, the first rotating body 120 is formed so as to be downwardly inclined from the inner side toward the outer side of the radial direction at the outer peripheral portion 120*i*. Thus, the gradient of the first rotating body 120 becomes gentle in the vicinity of the medicine riding-over position X. With this configuration, it is possible to smoothly transfer and place the medicines from the first rotating body 120 onto the second rotating body 130. Further, by forming the outer peripheral portion 120*i* of the first rotating body 120 into the shape downwardly inclined from the inner side toward the outer side of the radial direction, it is possible to set the arrangement angle (the gradient) as the whole of the first rotating body 120 to be higher. With this configuration, it is possible to suppress a square measure required for arranging the first rotating body 120 to a minimum, thereby suppressing the width and the length of the medicine cassette 100 and making the medicine cassette 100 compact.

In this regard, although the example in which the first rotating body 120 is formed into the concave portion on the side of the medicine containing part 182 is described in this embodiment, the present invention is not limited thereto and the first rotating body 120 may not be formed into the concave portion. Further, although the example in which the first rotating body 120 is formed so as to be downwardly inclined from the inner side toward the outer side of the radial direction at the outer peripheral portion 120*i* is described in this embodiment, the present invention is not limited thereto and it may be possible to take a configuration in which the first rotating body 120 is not inclined at the outer peripheral portion 120*i*.

In this embodiment, the connecting portion 120*e* for connecting the first rotating body 120 to the side of the driving force source is provided on the outer side of the medicine containing part 182. Further, the surface of the first rotating body 120 on the side of the medicine containing part 182 is formed continuously to the area adjacent to the area corresponding to the connecting portion 120*e* and does not have a discontinuously protruding portion. Thus, it is possible to suppress a decrease of the volume of the medicine containing part 182 caused by the connecting portion 120*e* to a minimum. Further, in the case of inclining the medicine cassette 100 for collecting the medicines, there is no portion contacting with the medicines and thus problems such as bouncing of the medicines do not occur. In this regard, although the example in which the discontinuous portion such as a protrusion protruding toward the side of the medicine containing part 182 caused by the connecting portion 120*e* is not formed is described in this embodiment, the present invention is not limited thereto and the discontinuous portion may be formed.

Further, according to the medicine cassette 100 of this embodiment, by inclining the cassette main body 140 in the state that the cover body 102 is opened, it is possible to collect the medicines remaining in the medicine containing part 182. Further, in the medicine cassette 100, the rotating guide portion 142*j* for guiding the medicines to be collected is provided at the position opposite to the support axis of the cover body 102 in the cassette 140. Thus, according to the medicine cassette 100, it is possible to easily and smoothly perform the collecting operation for the medicines in the medicine containing part 182. In this regard, the example in which the guide portion 144*b* is provided is described in this embodiment, the present invention is not limited thereto and the guide portion 144*b* may not be provided. Further, the shape and the position of the guide portion 144*b* is not limited to the above-described one and it is possible to appropriately change the shape and the position to an efficient shape and position for collecting the medicines.

The medicine cassette 100 of this embodiment includes the cassette connecting mechanism 73. The cassette connecting mechanism 73 can allow the two engaging pieces 78*d*, 78*d* provided on the side of the base portion 60 with being spaced apart from each other to respectively engage with the two receiving portions 142*x*, 142*x* provided on the side of the medicine cassette 100 (the cassette main body 140) to fix the medicine cassette 100 with respect to the base portion 60 with a correct posture without inclining with respect to the base portion 60. In this regard, although the example in which the engaging pieces 78*d*, 78*d* are provided on the side of the base portion 60 and the receiving portions 142*x*, 142*x* are provided on the side of the medicine cassette 100 is described in this embodiment, it may be possible to take an appropriate configuration in which the engaging pieces 78*d*, 78*d* are provided on the side of the medicine cassette 100 and the receiving portions 142*x*, 142*x* are provided on the base portion 60, for example. Further, the medicine cassette 100 may not include the cassette connecting mechanism 73.

In the above-mentioned medicine dispensing apparatus 55, the cover-side insertion area 102*a* is provided in the cover body 102 of the medicine cassette 100 and the base-side insertion area 80*d* is provided in the base portion 60. Thus, even if a plurality of medicine dispensing apparatuses 55 are arranged in the vertical direction so as not to be spaced apart from each other, it is possible to perform the attaching and detaching operation for the medicine cassette 100 with respect to the base portion 60 by inserting the fingers into the cover-side insertion area 102*a* and the base-side insertion area 80*d* to clip the front side of the medicine cassette 100. Thus, with the above-mentioned configuration, it is possible to easily and reliably perform the attaching and detaching operation for the medicine cassette 100. In this regard, although the example in which the cover-side insertion area 102*a* and the base-side insertion area 80*d* are provided is described in this embodiment, the present invention is not limited thereto and it may be possible to take a configuration in which one or both of the cover-side insertion area 102*a* and the base-side insertion area 80*d* are not provided.

Figure 25A:
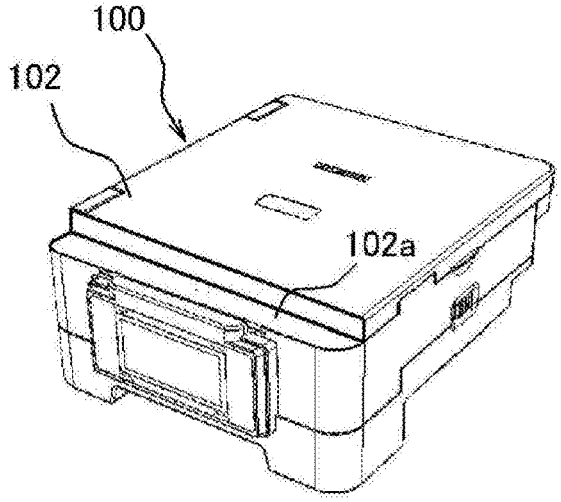
FIG. 25A is a modified example of a cover-side insertion area and each of FIGS. 25B and 25C is a perspective view showing a modified example of a base-side insertion area.
Figure 25B:
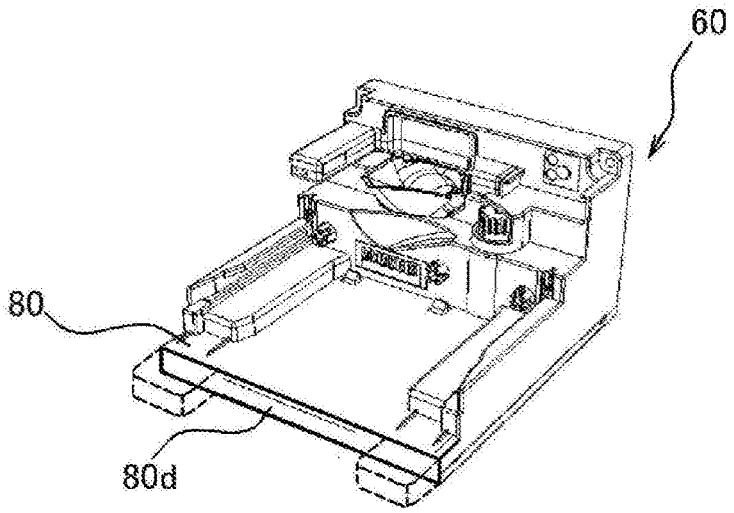
Figure 25C:
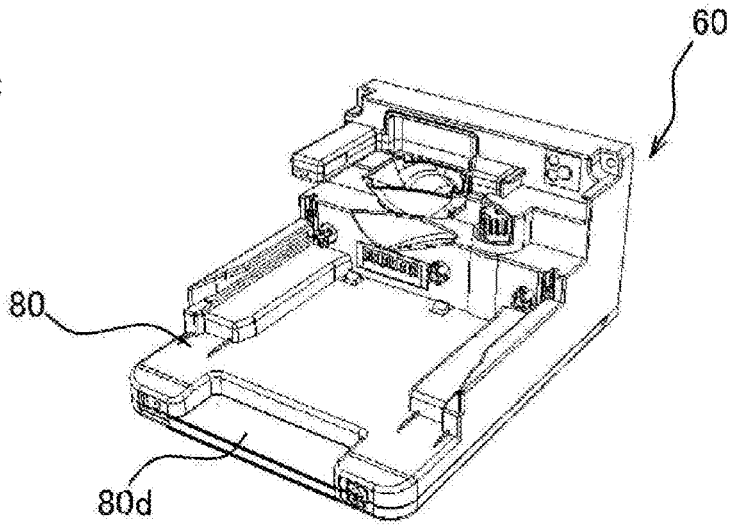

Further, although the cover-side insertion area 102*a* and the base-side insertion area 80*d* are formed with the cutouts formed by concaving a part of the front side of the medicine dispensing apparatus 55 toward the rear side in this embodiment, the present invention is not limited thereto. Specifically, each of the cover-side insertion area 102*a* and the base-side insertion area 80*d* may be formed into a shape obtained by cutting an overall width of the front side area of the medicine dispensing apparatus 55 toward the rear side as is the case with the cover-side insertion area 102*a* shown in FIG. 25A. Further, as shown in FIG. 25B, the cover-side insertion area 102*a* may be formed into a shape obtained by removing the portion indicated by the dotted line in FIG. 25B and cutting the overall width of the front side area of the medicine dispensing apparatus 55 toward the rear side. Namely, one or both of the cover body 102 and the bottom-side portion 80 of the base portion 60 may be formed into a shape which is not flat with respect to the anterior surface (the front surface) of the cassette main body 140 and positioned on the rear side of the anterior surface (the front surface). Further, although the example in which the base-side insertion area 80*d* is formed by providing the cutout or the concave portion communicated from the upper surface side to the lower surface side of the base portion 60 is described in this embodiment, the present invention is not limited thereto. Specifically, as shown in FIG. 25C, the base-side insertion area 80*d* may be formed by a concave or a cutout provided in only the upper surface side of the base portion 60.

As described above, the control device 200 performs the rotation control for reversely rotating the second rotating body 130 by the predetermined amount every time when the dispensing of the medicines is detected along with the normal rotation of the second rotating body 130 in the medicine dispensing process. By performing such rotation control, the clearances between the medicines on the second rotating body 130 are expanded. With this configuration, it is possible to suppress another medicine subsequent to the medicine to be dispensed from being mistakenly dispensed. In this regard, although the example in which the control device 200 constitutes the discharging status determining apparatus and the cassette control device of the present invention is described in this embodiment, the present invention is not limited thereto. Namely, one or both of the discharging status determining device and the cassette control device may be constituted of another device than the control device 200. Further, although the example in which the second rotating body 130 is reversely rotated every time when one medicine is dispensed is described in this embodiment, the present invention is not limited thereto. Specifically, it may be possible to take a configuration in which the control for reversely rotating the second rotating body 130 is not performed after the dispensing of the medicines is detected or the second rotating body 130 is reversely rotated regularly or at an irregular predetermined timing.

In this embodiment, the medicine dispensing preparation process (the step 1-5) is performed prior to the medicine dispensing process (the step 1-6) in the packaging process. In the time period when the medicine dispensing preparation process is performed, that is the time period from the timing at which it is expected that the medicines are transferred and placed from the medicine containing part 182 onto the second rotating body 130 along with the rotation of the first rotating body 120 to the timing at which it is expected that the medicine located at the head position of the transferring direction among the medicines transferred and placed onto the second rotating body 130 and transferred toward the side of the medicine discharging part 144*c* reaches the predetermined position, the rotational speed of the second rotating body 130 is set to be higher than that at the time of the medicine dispensing process. With this configuration, it is possible to suppress the time required for enabling the medicines transferred and placed onto the second rotating body 130 to reach in the vicinity of the medicine discharging part 144*c* to a minimum and smoothly start the dispensing of the medicines.

In this regard, although the example in which the medicine dispensing preparation process is performed in order to reduce the required time until the head (first) medicine is dispensed is described in this embodiment, the present invention is not limited thereto and it may be possible to take a configuration in which the medicine dispensing preparation process is not performed. Further, although the example in which the first rotating body 120 is also rotated with the higher speed than that at the time of the medicine dispensing process in addition to the second rotating body 130 in the medicine dispensing preparation process is described, the present invention is not limited thereto. Specifically, it may be possible to take a configuration in which the first rotating body 120 is rotated with the same speed as that at the time of the medicine dispensing process or the rotational speed of the first rotating body 120 becomes slow at the time of detecting the transferring and placing of the medicines onto the second rotating body 130 (step 1-5-2=YES). Although the example in which the control device 200 constitutes the cassette control device of the present invention and performs the control related to the medicine preparing process, the present invention is not limited thereto and it may be possible to take a configuration in which another device corresponding to the cassette control device for performing the control related to the medicine preparing process is provided.

In this embodiment, the determination that the dispensing error of the medicines occurs is performed by the control device 200 in the medicine dispensing process on the condition that the discharging of the medicines is not detected by the discharged medicine detecting device 82*b* even after the second rotating body 130 is rotated over the predetermined time and the medicines are detected by the transferred medicine detecting body 145. With this configuration, it is possible to accurately determine whether or not the dispensing error of the medicines occurs. Further, the operation (the dispensing error solving operation) for rotating the second rotating body 130 in the direction opposite to the discharging direction of the medicines is performed on the condition that the determination that the dispensing error of the medicines occurs is performed by the control device 200. With this configuration, it is possible to solve the dispensing error without troubling the hands of the user.

In this regard, although the example in which the determination control for the discharging error of the medicines or the performing control for the discharging error solving operation is performed is described in this embodiment, the present invention is not limited thereto and it may be possible to take a configuration in which one or both of these controls are not performed. Further, although the example in which the control device 200 constitutes the discharging status determining device and the cassette control device of the present invention is described in this embodiment, the present invention is not limited thereto and another device corresponding to the discharging status determining device or the cassette control device may be provided.

In this embodiment, the remaining medicine determining process (the step 1-7) is performed after the medicines are dispensed in the medicine dispensing process (the step 1-6). Further, in the remaining medicine determining process, the determination that there is the possibility that the medicines remain in the medicine cassette 100 is performed on the condition that the second rotating body 130 is rotated in the direction opposite to the discharging direction of the medicines and the medicines are detected by the transferred medicine detecting body 145 after the start of the reverse rotation. By performing the remaining medicine determining process as described above, it is possible to identify the possibility that the medicines remain in the medicine cassette 100 and inform this possibility to the user. In this regard, although the example in which the remaining medicine determining process is performed is described in this embodiment, the remaining medicine determining process is not an essential process in the present invention and it is possible to appropriately omit the remaining medicine determining process. Further, although the example in which the control device 200 constitutes the remaining medicine determining device of the present invention, the present invention is not limited thereto and another device corresponding to the remaining medicine determining device may be provided.

Further, in this embodiment, the first rotating body 120 is rotated with the slower speed than that at the time of the transferring and placing operation, stopped or irregularly rotated on the condition that the medicines are detected by the transferred medicine detecting body 145. Specifically, in the case of detecting that the medicines exist on the second rotating body 130 in the medicine dispensing process (step 1-6-2=YES), the first rotating body 120 is brought into the stand-by state (the step 1-6-3) and the first rotating body 120 is rotated with the slower speed than that at the time of the transferring and placing operation, stopped or irregularly rotated. With this configuration, it is possible to collapse the posture of the medicines in the medicine containing part 182 and suppress the medicines in the medicine containing part 182 from being mistakenly detected as being existing on the second rotating body 130. Further, by rotating the first rotating body 120 with the slower speed than that in the transferring and placing operation, stopping or irregularly rotating the first rotating body 120, it is possible to suppress load applied to the medicines in the medicine containing part 182 to a minimum and suppress breakage or abrasion of the medicines.

In this regard, although the first rotating body 120 is rotated with the slower speed, stopped or irregularly rotated at the time of bringing the first rotating body 120 into the stand-by state in this embodiment in order to suppress the medicines from being detected as being existing on the second rotating body 130 by the transferred medicine detecting body 145, the present invention is not limited thereto and it may be possible to take a configuration in which the first rotating body 120 is not brought into the stand-by state. Further, although the example in which the control device 200 is used for controlling the first rotating body 120 so as to bring the first rotating body 120 into the stand-by state is described in this embodiment, it may be possible to employ another device than the control device 200 as a control device (equivalent to the cassette control device of the present invention) performing such control.

Further, according to the medicine packaging apparatus 10, the medicine dispensing apparatus 55 and the medicine cassette 100 described above, it is possible to suppress the occurrence of the human errors caused by the manual operations and smoothly dispense the medicines with a minimum space to package the medicines.

The present invention is not limited to the configuration described in the above embodiment and various modifications can be applied to the present invention.

For example, although the case where the medicines whose use frequency is low are packaged by utilizing the medicine dispensing apparatus 55 is described in the above-mentioned embodiment, this medicine dispensing apparatus 55 can be utilized for a case of counting the number of the medicines. In this case, another route than the discharging route to the side of the packaging part for guiding the medicines discharged from the hopper 82*a* to the front side of the attached medicine cassette 100 as is the above-mentioned case is formed and the medicines discharged from this other route are collected with a vial bottle or the like. Further, in a case of dispensing the medicines into the vial bottle by a predetermined amount, the method can be also used.

Further, it is possible to employ the medicine cassette 100 used in the medicine dispensing apparatus 55 as the medicine cassette 22 of the first medicine supplying part 20 or employ the medicine dispensing apparatus 55 or the medicine cassette 100 in the manually distributed medicine supplying part 30. In a case of employing the medicine cassette 100 or the medicine dispensing apparatus 55 as the medicine cassette 22 or in the manually distributed medicine supplying part 30, it is also possible to appropriately omit a part of the configuration and simplify the configuration.

In the above-mentioned medicine packaging apparatus 10, the display panel 146 (the display device) is provided in the medicine dispensing apparatus 55. Although the control for allowing the display device 146 to display the information such as medicine information can be appropriately performed by the control device 200 and the like, it is preferable that the control is performed so as to reliably allow the display panel 146 to display the necessary information or sufficiently protect the display panel 146. Specifically, if the medicine cassette 100 is removed during the rewriting time from the start to the end of the transmitting of the display data for the information displaying to the display panel 146 or the like and the power supply to the display panel 146 is interrupted, the necessary information cannot be displayed on the display panel 146 and this may cause failure of the display panel 146. Thus, it is preferable that the operation control for each part is performed so that the power supply to the display panel 146 is not interrupted during the rewriting time. Further, with considering the phenomenon found by the inventors that the rewriting time varies depending on the temperature condition (the environment temperature condition) of the location where the medicine dispensing apparatus 55 is set, it is preferable that the rewriting time is set based on the environment temperature condition and the control is performed so that the connection between the display panel 146 and the power supplying part 72 which is the power supply source is not released during this rewriting time.

Figure 22:
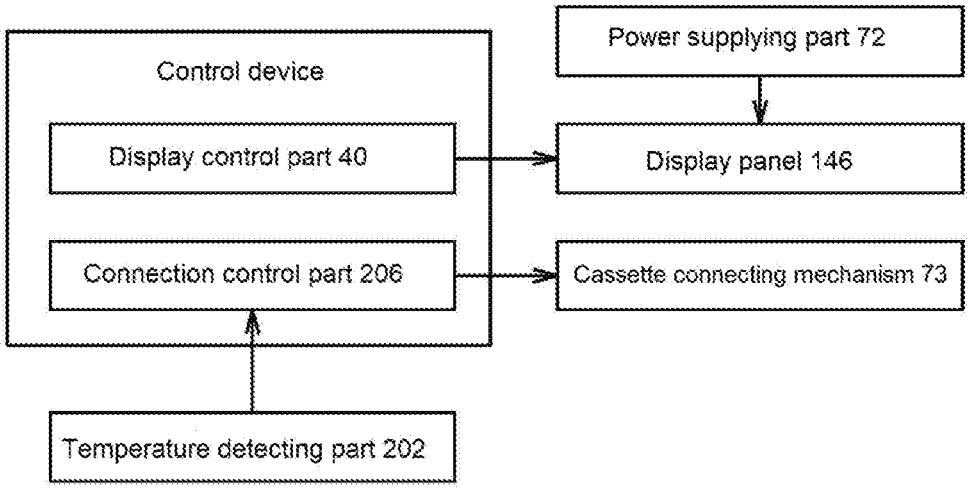
FIG. 22 is a block diagram showing one example of a configuration which can realize a display changing process shown in FIG. 23.

Based on the above-mentioned knowledge, the medicine packaging apparatus 10 or the medicine dispensing apparatus 55 may include a configuration shown in the block diagram in FIG. 22, for example. Specifically, in the example shown in FIG. 22, a temperature detecting part 202 is provided and the control device 200 includes a display control part 204 (a display control device) and a connection control part 206 (a connection control device). Hereinafter, this is described in detail based on FIG. 22 and the like.

The temperature detecting part 202 can detect a temperature of a setting environment (a setting environment temperature t). For example, the temperature detecting part 202 is constituted of a temperature sensor and is configured to detect the setting environment temperature t for every medicine cassette 100. Although the temperature detecting part 202 may be set at any location, the temperature detecting part 202 is arranged in each medicine cassette 100 so as to be positioned in the vicinity of an electronic substrate having a function of the display control part 204 described later in detail in this embodiment.

The display control part 204 can create the display data used for allowing the display panel 146 to display the information and transmit the display data to the display panel 146.

The display control part 206 is used for controlling so as to keep a connection between the power supplying part 72 which is an electric power supply source (a power supplying part) for the display panel 146 and the display panel 146. In this embodiment, when the medicine cassette 100 is attached to the base portion 60, the power supplying part 72 and the display panel 16 are brought in a state that they are electrically connected with each other. Further, in this embodiment, a cassette connecting mechanism 73 (a connection keeping part) is provided as a mechanism for keeping the connection of the medicine cassette 100 attached to the base portion 60. Thus, the connection control part 206 can perform operation control for the cassette connecting mechanism 73 to perform control for keeping the connection between the power supplying part 72 and the display panel 146.

Figure 24A:
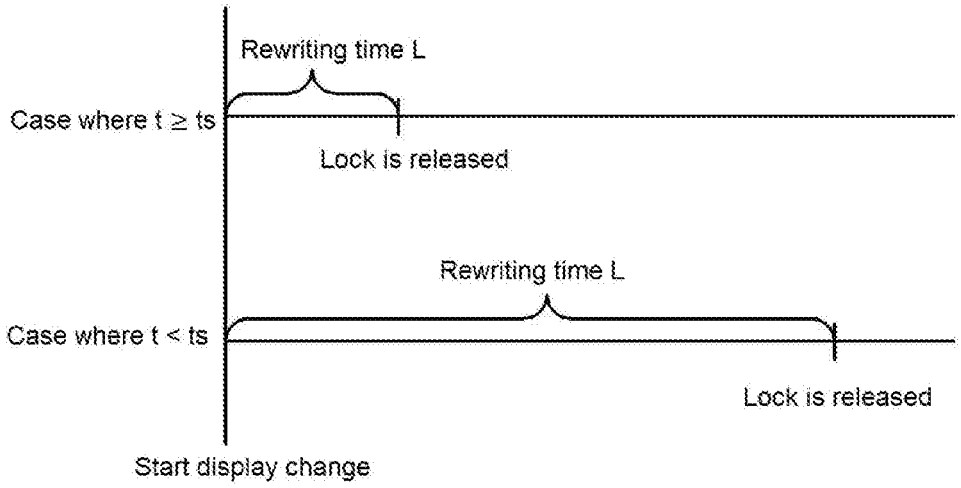
FIG. 24A is an explanatory diagram showing a relationship between an atmospheric temperature and a rewriting time at the time of performing the display changing process and FIG. 24B is an explanatory diagram showing a relationship between the atmospheric temperature and the rewriting time at the time of performing the display changing process in a case of providing a supplementary power supplying device.

Further, the connection control part 206 can set the rewriting time L based on the setting environment temperature t detected by the temperature detecting part 202. The rewriting time L can be set with various methods such as a method of setting the rewriting time L based on a predefined arithmetic equation and a method of setting the rewriting time L in a phased manner depending on whether the setting environment temperature t is higher or lower than a predetermined threshold temperature is used as a reference. In this embodiment, the latter setting method is employed and the rewriting time L in a case where the environment temperature t is higher than the predetermined threshold temperature ts (for example, 3 seconds) is set to be shorter than the rewriting time L in a case where the environment temperature t is lower than the predetermined threshold temperature ts (for example, 15 seconds) as shown in FIG. 24A. With this configuration, the rewriting time L can be switched in a two-phase manner based on the setting environment temperature t.

Figure 23:
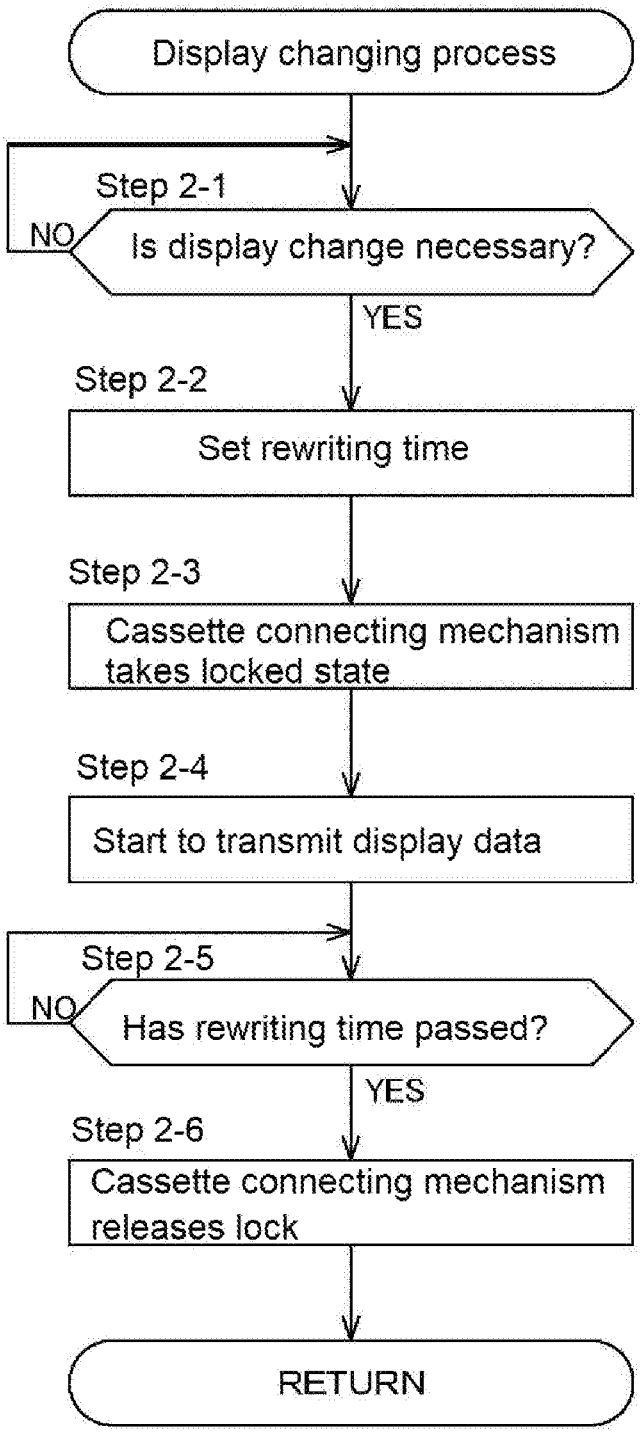
FIG. 23 is a flow chart showing one example of the display changing process.

A process (a display changing process) related to display change for the display panel 146 performed in the case of employing the configuration shown in the above-mentioned block diagram in FIG. 22 will be described according to the flow chart shown in FIG. 23.

(Step 2-1)

At a step 2-1, the control device 200 determines whether or not the display change for the display panel 146 is necessary. Here, in a case where the display change is necessary (step 2-1=YES), the process is shifted to a step 2-2. In a case where the display change is not necessary (step 2-1=NO), the determination whether or not the display change is necessary is continued.

(Step 2-2)

At the step 2-2, a process of setting the rewriting time L based on the setting environment temperature t detected by the temperature detecting part 202 is performed by the connection control part 206. In this embodiment, the rewriting time L is set according to the determination whether or not the setting environment temperature t detected by the temperature detecting part 202 is on the higher side with respect to the threshold temperature ts used as the reference. After that, the process is shifted to a step 2-3.

(Step 2-3)

At the step 2-3, the operation control for the cassette connecting mechanism 73 is performed by the connection control part 206 so that a state (a locked state) that the medicine cassette 100 is connected to the base portion 60 is kept and the power supply from the power supplying part 72 is not physically interrupted. After that, the process is shifted to a step 2-4.

(Step 2-4)

At the step 2-4, the display data used for allowing the display panel 146 to display the information is created by the display control part 204 and transmitted to the side of the display panel 146. After that, the process is shifted to a step 2-5.

(Step 2-5)

At the step 2-5, the determination whether or not the time period corresponding to the rewriting time L has passed from the start time of the transmitting of the display data is performed by the connection control part 206. In a case of determining that the time period corresponding to the rewriting time L has not passed (step 2-5=NO), the process stands by at the step 2-5. In a case of determining that the time period corresponding to the rewriting time L has passed (step 2-5=YES), the process is shifted to a step 2-6.

(Step 2-6)

At the step 2-6, operation control for the cassette connecting mechanism 73 is performed by the connection control part 206 so as to take a state (a lock released state) that the lock of the medicine cassette 100 with respect to the base portion 60 is released. With this control, the series of control flows are completed.

As described above, by preventing the medicine cassette 100 from being removed during the rewriting time from the start to the end of transmitting the display data for the display change to the display panel 146, it is possible to reliably allow the display panel 146 to display the necessary information and prevent errors such as failure of the display panel 146 caused by unexpected power supply interruption. Further, by changing the rewriting time L depending on the environment temperature condition, it is possible to further improve the reliability of the information displaying to the display panel 146 and significantly reduce the errors such as the failure of the display panel 146.

In this regard, the configuration or the control method for preventing the medicine cassette 100 from being removed during the time period from the start to the end of transmitting the display data for the information displaying to the display panel 146 are not limited to the above-described ones and can be appropriately modified. Further, such configuration and control are not essential for the medicine packaging apparatus 10 and the medicine dispensing apparatus 55 and can be also appropriately omitted.

Further, although the example in which the rewriting time L is changed depending on the environment temperature condition is described in the above-mentioned example, the present invention is not limited thereto and the rewriting time L may be constant regardless of the environment temperature condition. In this case, it is preferable that the rewriting time L is set to be long in order to suppress the power supply to the display panel 146 from being interrupted while the displaying of the display panel 146 is being changed. Further, although the example in which only the environment temperature condition is employed as a changing factor for the rewriting time L is described in the above-mentioned example, another condition may be considered for optimizing the rewriting time L.

Figure 24B:
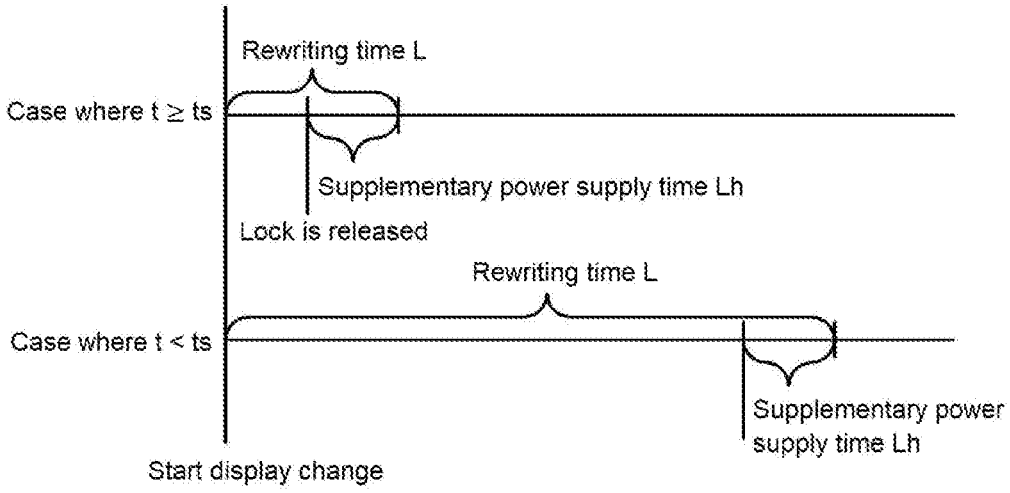

Further, although the configuration in which the power supply to the display panel 146 is stopped immediately after the connection to the power supplying part 72 is released is described in this embodiment, the present invention is not limited thereto. Specifically, it may be possible to take a configuration in which a supplementary power supplying device such as a capacitor and a condenser may be provided in the medicine cassette 100 to supply the electric power to the display panel 146 during a predetermined supplementary power supply time Lh which is shorter than the rewriting time when the connection to the power supplying part 72 is released. In this case, as shown in FIG. 24B, even if the time period from the timing at which the process for rewriting the displaying of the display panel 146 is started to the timing at which the lock released state can be taken is shortened by the amount corresponding to the supplementary power supply time Lh, errors such as an error of the display change of the display panel 146 do not occur.

Up to here, although the representative embodiments of the present invention are described, it should be noted that various design changes can be performed within the scope of the technical idea of the present invention described in the claims and all of such modifications are also involved in the present invention.

The present invention can be preferably used in general medicine packaging apparatuses for packaging medicines, general medicine dispensing apparatuses for dispensing medicines and general medicine cassettes.

What is claimed is:

1. A medicine dispensing apparatus comprising a medicine cassette, said medicine cassette comprising:

a side-wall constituent body constituting a side-wall of a medicine containing part in which medicines should be contained;

a first rotating body which is arranged so as to be inclined from a bottom side toward an upper end side of the side-wall constituent body and can rotate around a first rotational axis;

a second rotating body which is arranged on an upper-side outer periphery of the side-wall constituent body and which can rotate around a second rotational axis; and a medicine discharging part for discharging the medicines, wherein the medicine cassette is configured to transfer and place the medicines prepared in the medicine containing part onto the second rotating body due to a rotation of the first rotating body and transfer the medicines toward a downstream side of a rotational direction of the second rotating body to discharge the medicines from the medicine discharging part, and wherein a transferred medicine detecting device configured to detect the medicines in a transfer path to the medicine discharging part after the medicines are transferred and placed from the first rotating body onto the second rotating body is provided in the medicine cassette; and a cassette control device for performing operation control for the medicine cassette, wherein the cassette control device performs a transferring and placing operation for rotating the first rotating body to transfer and place the medicines in the medicine containing part onto the second rotating body on a condition that the medicine is not detected by the transferred medicine detecting device and rotates the first rotating body with a lower speed than that at the time of the transferring and placing operation, stops or irregularly rotates the first rotating body on a condition that the medicine is detected by the transferred medicine detecting device.

2. The medicine dispensing apparatus according to claim 1 further comprises a medicine containing part to contain the medicines and to dispense the medicines prepared in the medicine containing part based on prescription data, said medicine containing part comprising:

a display device provided on the medicine containing part;

a display control device which can transmit display data used for allowing the display device to display information to the display device, a power supplying part electrically connected to the display device to supply electric power used for allowing the display device to display display-contents related to the display data to the display device;

a connection keeping part for keeping a connected state between the power supplying part and the display device, a temperature detecting part which can detect a setting environment temperature; and a connection control part for setting a rewriting time with using a start time of transmitting the display data by the display control device as a reference and controlling the connection keeping part so that a connection between the power supplying part and the display device is kept over the rewriting time, and wherein the connection control part sets the rewriting time based on the detected temperature due to the temperature detecting part.

3. A medicine packaging apparatus, comprising:

the medicine dispensing apparatus according to claim 1; and a packaging part for packaging the medicines dispensed from the medicine cassette.

4. The medicine dispensing apparatus according to claim 1, wherein the side-wall constituent body of the medicine cassette has an expanding portion expanding toward an outer side of a radial direction of the second rotating body on a lower side of the second rotating body.

5. The medicine dispensing apparatus according to claim 1, wherein when an area of an outer peripheral edge of the first rotating body and an inner peripheral edge of the second rotating body of the medicine cassette are adjacent to each other, defined as a riding-over side area, and an area on the opposite side of a radial direction of the first rotating body with respect to the ride-over side area, defined as a scraping-up side area, the expanding portion is provided at least in the scraping-up side area.

6. The medicine dispensing apparatus according to claim 1, wherein the first rotating body of the medicine cassette is formed into a concave shape on the side of the medicine containing part.

7. The medicine dispensing apparatus according to claim 1, wherein a gradient of a direction directed from an inner side toward an outer side of a radial direction of the first rotating body of the medicine cassette at an outer peripheral portion of the first rotating body is smaller than a gradient of the direction directed from the inner side toward the outer side of the radial direction at an inner peripheral portion of the first rotating body.

8. The medicine dispensing apparatus according to claim 1, wherein the first rotating body of the medicine cassette on the side of the medicine containing part is formed into a concave shape in an area on the inner side of the radial direction with respect to the outer peripheral portion.

9. The medicine dispensing apparatus according to claim 1, wherein a connecting portion for connecting the first rotating body of the medicine cassette to a side of a driving source is arranged on an outer side of the medicine containing part.

10. The medicine dispensing apparatus according to claim 1, wherein the medicine cassette further comprising:

a cassette main body containing at least the side-wall constituent body, the first rotating body and the second rotating body, and a cover body which can be opened and closed on the upper end side of the side-wall constituent body, wherein the cover body is formed into a shape in which all or a part of an area adjacent to a front side of the cassette main body is cut so as to provide a cover-side insertion area into which fingers can be inserted from the front side toward a rear side of the cassette main body.

11. The medicine dispensing apparatus according to claim 1 further comprising a base portion to which the medicine cassette can be attached and detached, wherein the medicine cassette includes a cassette main body containing at least the side-wall constituent body, the first rotating body and the second rotating body, wherein the base portion is formed into a shape in which all or a part of an area adjacent to a front side of the cassette main body is cut, and wherein when another medicine cassette is arranged on a lower side of the base portion, a base-side insertion area into which fingers can be inserted between the other medicine cassette and the base portion from the front side toward a rear side of the cassette main body is provided in the base portion.

12. The medicine dispensing apparatus according to claim 1, further comprising:

a cassette control device for performing operation control for the medicine cassette; and a discharging status determining device for determining a discharging status of the medicines in the medicine discharging part, wherein rotation control for reversely rotating the second rotating body by a predetermined amount is performed by the cassette control device every time when the discharging of the medicines is detected by the discharging status determining device along with a normal rotation of the second rotating body.

13. The medicine dispensing apparatus according to claim 1, wherein rotation control for the second rotating body is performed by the cassette control device so that a rotational speed at the time of a reverse rotation is higher than a rotational speed at the time of a normal rotation.

14. The medicine dispensing apparatus according to claim 1 further comprising a cassette control device for performing operation control for the medicine cassette, wherein rotation control for the second rotating body is performed so that a rotational speed of the second rotating body in a time period from a timing at which it is expected that the medicines are transferred and placed from the medicine containing part onto the second rotating body due to the rotation of the first rotating body to a timing at which it is expected that the medicine located at a head position in a transferring direction among the medicines transferred and placed on the second rotating body and transferred to a side of the medicine discharging part reaches a predetermined position is higher than a rotational speed of the second rotating body after the medicine located at the head position in the transferring direction goes through the predetermined position.

15. The medicine dispensing apparatus according to claim 1 further comprising a discharging status determining device for determining a discharging status of the medicines at the medicine discharging part, wherein the medicines are detected by the transferred medicine detecting device in a state that the second rotating body rotates for longer than a predetermined time, and wherein the discharging status determining device determines that a dispensing error of the medicines occurs on a condition that discharging of the medicines is not detected by the discharging medicine detecting device.

16. The medicine dispensing apparatus according to claim 1 further comprising a remaining medicine determining device for determining a remaining possibility of the medicine in the medicine cassette, wherein the remaining medicine determining device determines that there is a possibility that the medicines remain in the medicine cassette on a condition that the second rotating body is rotated in a direction opposite to a discharging direction of the medicines after the dispensing of the medicines due to the medicine cassette is completed and the medicine is detected by the transferred medicine detecting device after start of a reverse rotation of the second rotating body.

* * * * *